United States Patent [19]

Ogihara et al.

[11] Patent Number: 4,755,835

[45] Date of Patent: Jul. 5, 1988

[54] TIME RECORDER WITH PRINTING WHEELS AND IMPRESSION HAMMER

[75] Inventors: Masuo Ogihara; Hajime Oda; Tadashi Ishikawa; Atsushi Takami; Toshiya Tamura, all of Yotsukaido, Japan

[73] Assignee: Seikosha Co., Ltd., Tokyo, Japan

[21] Appl. No.: 911,250

[22] Filed: Sep. 24, 1986

[30] Foreign Application Priority Data

| | | | |
|---|---|---|---|
| Sep. 24, 1985 | [JP] | Japan | 60-145608[U] |
| Sep. 24, 1985 | [JP] | Japan | 60-145609[U] |
| Sep. 24, 1985 | [JP] | Japan | 60-210489 |
| Sep. 24, 1985 | [JP] | Japan | 60-210490 |
| Nov. 13, 1985 | [JP] | Japan | 60-174813[U] |

[51] Int. Cl.[4] ..... H07C 1/10

[52] U.S. Cl. ..... 346/82; 235/377

[58] Field of Search ..... 346/82, 83, 86, 88, 346/91, 92, 134; 235/377, 419; 368/157, 160, 202

[56] References Cited

U.S. PATENT DOCUMENTS

| | | | |
|---|---|---|---|
| 3,942,182 | 3/1976 | Sato | 346/82 X |
| 4,401,994 | 8/1983 | Witts et al. | 346/134 X |
| 4,423,315 | 12/1983 | Kato et al. | 346/82 X |
| 4,494,127 | 1/1985 | King | 346/134 X |
| 4,506,274 | 3/1985 | Coe | 346/82 |

*Primary Examiner*—A. D. Pellinen
*Assistant Examiner*—Derek S. Jennings
*Attorney, Agent, or Firm*—Bruce L. Adams; Van C. Wilks

[57] ABSTRACT

A time recorder includes a clock circuit for producing a clock signal, a detector for detecting when a time card is loaded in the time recorder to produce a detection signal, and a correcting circuit for producing a correcting signal effective to correct time information. A printing wheel assembly is rotationally driven to print the time information which is displayed in a display device. A positioning mechanism receives the loaded time card and moves relative to the printing wheel assembly for positioning the loaded time card in a print position relative to the printing wheel assembly. A hammer is opposed to the loaded time card and actuated to act thereon against the printing wheel assembly to thereby print the time information. The display device, printing wheel assembly and positioning mechanism are driven in synchronization with one another to update and correct the displayed time information, the time information to be printed and the position of the time card in response to the clock and correcting signals. The hammer is actuated in response to the detection signal without relative interference with the drive of the printing wheel assembly and positioning mechanism.

23 Claims, 28 Drawing Sheets

TIME RECORDER WITH PRINTING WHEELS AND IMPRESSION HAMMER

BACKGROUND OF THE INVENTION

The present invention relates to a time recorder and more particularly to a time recorder in which recording means of the time of hours and minutes and recording means of the date are adapted to be driven by separate drive systems.

The present invention relates to a technique for time correction for a clock apparatus in response to a common timing signal for displaying the date and time in both analog mode and digital mode.

The present invention relates to a technique for preventing erroneous printing in a time recorder.

This invention relates to an analog clock which can be corrected by a predetermined unit of time.

DESCRIPTION OF THE RELATED ART

In the conventional time recorders including the type described in Japanese Utility Model Laid-open No. 56-66456/1981, a single drive system performs operations such as carrying out the drive of all the printing wheels from minute to date wheels and the step feed drive of a time card requiring relatively large driving torque.

Therefore, there are such problems that a heavy load is liable to be exerted on the printing wheel of the lower order digit whereby the durability of the time recorder is impaired and that a complex mechanism must be provided for the time recorder for making correction of the date printing wheel and the step feed mechanism.

In the conventional time recorder, the time is displayed on an analog display mechanism in mechanical interlock with a printing wheel assembly and the date is displayed on a digital display mechanism in response to signals from a common clock circuit. When correcting the contents of the display on either display mechanism, one of the display mechanism is selected by a mode switch and then corrections are carried out by operating a common select button and set button.

In such an arrangement, cost-down and miniaturization of the time recorder can be achieved by the design of the switches adapted to be used in common, but if the selector switch is not returned to the lock mode after the selection, there are produced such problems that the display portion is left disconnected from the clock circuit and an erroneous display is thereby produced in the time display, and that the selector switch is left, reversely, connected with the circuit portion, and thereby, noise enters from the outside to cause malfunction, and so on.

In the conventional time recorder, a typing or printing wheel assembly is rotated to be set to the present date and time by a motor synchronously driven by a timing signal from a clock circuit and, when a time card is inserted therein, a printing hammer is operated to print characters on the card opposed to the printing wheel assembly but since there is a differential between the operating point of card detecting means and the reference position of the card, there is a problem that the printing hammer is operated before the card reaches the reference position and thereby some slippage in printing is liable to be produced.

In the conventional time recorder, a printing wheel assembly is synchronized to the current time by a motor driven by a timing signal from a clock circuit and a printing hammer is operated when insertion of a time card is detected so that characters on the printing wheel assembly may be printed in the card.

Therefore, there are such problems when the timing signal is output during the printing operation that the dislocation of printed characters is caused by rotation of the printing wheel assembly and resultant movement of the type face and that a heavy load is applied to the motor due to the movement of the printing wheel assembly under pressure of the printing hammer.

In the conventional time recorder, a clock which employes an analog display mechanism therein normally includes a stepping motor which is rotated in response to a clock signal developed for each second or for each minute from a clock circuit to advance a second or a minute hand for each second or for each minute. Accordingly, for correction of the time, an adjusting knob which can be operated from the outside may be operated to turn only the hand while the connection between the hand and the stepping motor is cut.

However, in correcting for a relatively large amount of time as in correcting for difference of time between different remote places, it is a problem that a time required for the correcting operation causes a considerable time error and renders indication of the time inaccurate. Further, in a clock such as, for example, incorporated in a time recorder wherein printing wheels for printing the time is interlocked with an analog display mechanism, a high torque is required to turn hands and other elements of the clock. Accordingly, the correction of the time by an adjusting knob may be impossible. Therefore, steps will be taken to rotate a stepping motor at a high speed in response to quick feed pulses from a pulse generating circuit to effect intended correction.

However, in correcting for a relatively long time, there is a similar problem to that for the manual correction described above.

SUMMARY OF THE INVENTION

The present invention is made to solve the foregoing various problems, and it is accordingly a first object of the present invention to provide a novel time recorder wherein the reduction of load and simplification of mechanism are achieved by providing two drive systems so that recording means of the time of hours and minutes and recording means of the date can be separately driven.

In order to achieve the above mentioned first object, the present invention provides a time recorder which comprises means for transmitting the rotation to recording means of the time of hours and minutes, and means for transmitting the rotation to recording means of the date disposed against a rotating member coupled with a driving power source, wherein both the means are coupled with the rotating member through means for transmitting the rotation only in the opposite rotating directions to each other.

A second object of the present device is to provide a time correcting mechanism wherein erroneous operations can be prevented even if, for example, the switch is not returned to the lock mode.

In order to achieve the second object of the present invention, the time recorder is provided with a switch that can be actuated by opening and closing movement of a lid for a panel having operating buttons for the time correction disposed thereon, and returning to the lock mode is achieved by means of a signal from this switch irrespective of the selected position by the mode switch.

A third object of the present invention is to provide a time recorder adapted such that the printing hammer can operate at the time when the card is set to the reference position.

A fourth object of the present invention is to provide a time recorder enabled to effect the printing operations only when the printing wheel assembly is in a stationary state.

It is a fifth object of the present invention to provide an analog clock which can be automatically corrected for a relatively long time error accurately and rapidly.

In order to achieve the fifth object of the present invention, a clock according to the present invention is characterized in that a hand is turned while correcting pulses are added to data of a clock circuit just before starting the correction, and the clock is returned to its normal operation at a point of time when the resultant data by the addition and data of the clock circuit become coincident with each other.

BRIEF DESCRIPTION OF THE DRAWINGS

FIGS. 3C-1 and 3C-2 are a timing chart showing operations of the apparatus of FIG. 1C.

FIGS. 2E-1 and 2E-2 are diagrammatic representations illustrating structure of data in a clock circuit and an operating circuit of the clock shown in FIG. 1E, respectively.

DESCRIPTION OF THE PREFERRED EMBODIMENTS

Now the description of details of the present invention will be given in the following based on the first embodiment in conjunction with the drawings.

Figure 1:
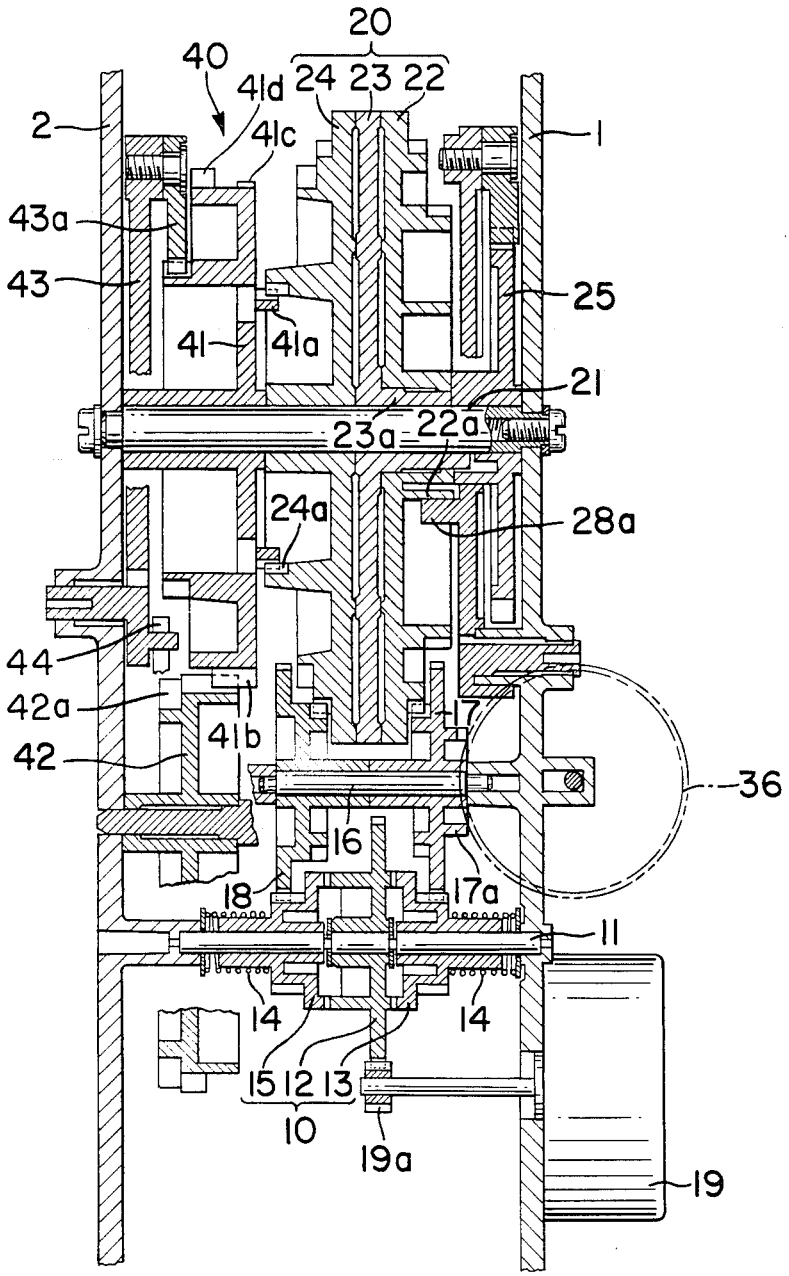
FIG. 1 is a sectional view showing principal portion of a time recorder according to the present invention.

FIG. 1 shows a central portion of the time recorder according to the present invention. This mechanism is basicly constituted by a clutch mechanism 10 driven by a step motor 19, a printing wheel assembly 20 driven by the clutch mechanism 10, a transmission mechanism 30 (FIG. 4) for transmitting rotation to hands 37 and 38 through a minute reduction wheel 17, a card feed mechanism 40 supplied with driving force from a date printing wheel 24 for stepwisely feeding a time record card, and a print mechanism 50 for printing the date and time in the inserted card c.

Describing detailed mechanism of each of these portions, a drive clutch wheel 12 engaging with a pinion **19*a* fixed to the shaft of the step motor 19 is loosely disposed around a clutch wheel shaft 11 supported between a pair of frame plates 1 and 2 on the right-hand and left-hand sides, and also on this clutch wheel shaft 11, there are loosely disposed a minute clutch wheel 13 and a date clutch wheel 15 axially urged by a pair of coil springs 14 inserted between the minute clutch wheel 13 and the plate 1 on the right-hand side and between the date clutch wheel 15 and the plate 2 on the left-hand side so as to squeeze the drive clutch wheel 12** from opposite sides.

Figure 2C:
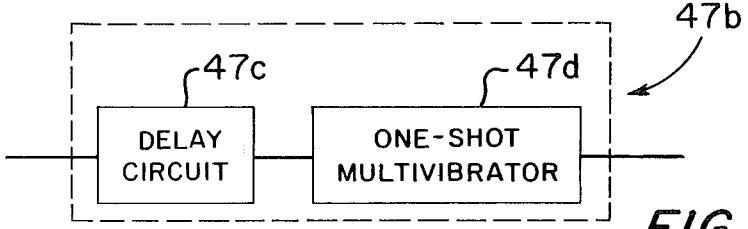
FIG. 2C is a block diagram showing an embodiment of the erroneous printing preventing circuit.
Figure 2:
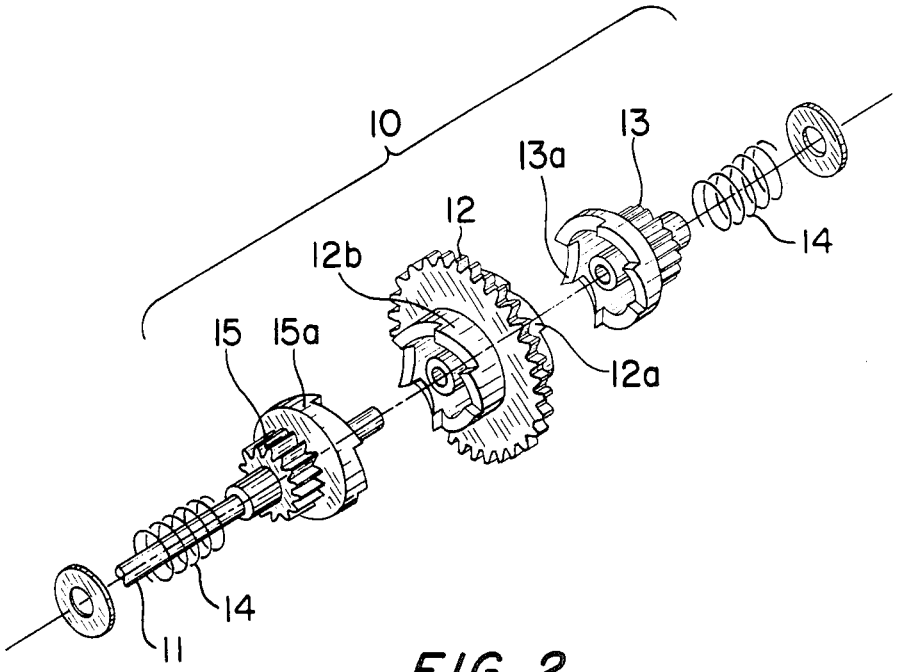
FIG. 2 is a prospective exploded view showing a clutch mechanism of the same.

FIG. 2 shows the clutch mechanism 10 in an exploded manner. On both sides of the clutch wheel 12, there are provided, integrally formed therewith and projected therefrom, a minute feed cylinder **12*a* and a date feed cylinder 12*b*with clutch pawls provided on their end faces in the opposite directions to each other. The minute clutch wheel 13 and the date clutch wheel 15 are respectively provided on their inner end faces with a minute feed cylinder 13*a* and a date feed cylinder 15*a* projected therefrom. Through the engagement between the clutch pawls provided on these end faces and the clutch pawls on both sides of the clutch wheel 12, when the drive clutch wheel 12 undergoes one clockwise complete rotation, in the drawing, every minute, the minute clutch wheel 13 in engagement with the minute feed cylinder 12*a* rotates a minute printing wheel 22 one step through the minute reduction wheel 17 (FIG. 1), and when the clutch wheel 12 undergoes a counterclockwise rotation, in the drawing, at 12 o'clock at night everyday, the date clutch wheel 15 in engagement with the date feed cylinder 12*b* rotates a date printing wheel 24 one step through a date reduction wheel 18**.

Returning to FIG. 1, the printing wheel assembly 20 for printing date and time in a specific section of the time card c is made up of the minute printing wheel 22, a hour printing wheel 23, and the date printing wheel 24 of the same diameter provided with typeface numerals 1 to 60, 1 to 24, and 1 to 31 protruded on their peripheral surfaces. These three printing wheels 22, 23 and 24 are disposed adjacent to each other. The date printing wheel 24 is connected to the date clutch wheel 15 through the date reduction wheel 18, and the hour printing wheel 23 is loosely disposed on a printing wheel shaft 21, while the minute printing wheel 22 is connected to the minute clutch wheel 13 through the minute reduction wheel 17 and loosely disposed on a boss portion 23*a* of the hour printing wheel 23.

Figure 3:
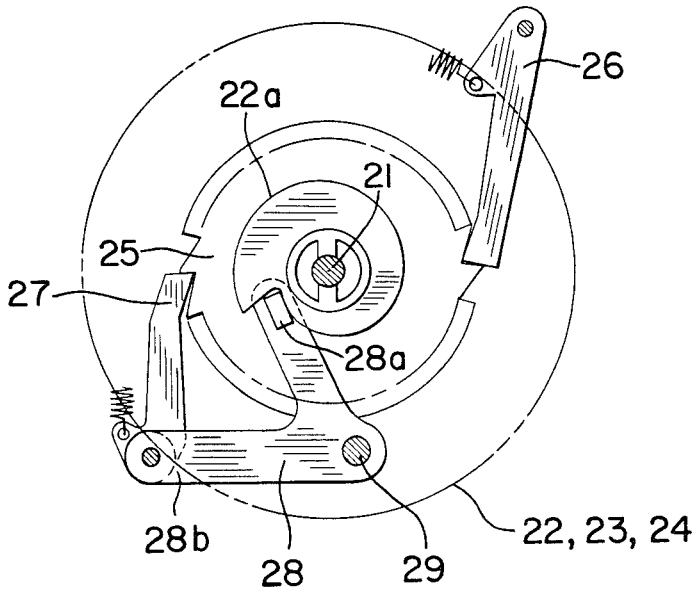
FIG. 3 is a plan view showing a ratchet wheel for driving an hour printing wheel.

Referring to FIG. 1, reference numeral 25 denotes a ratchet wheel for driving the hour printing wheel 23 joined to the end portion of the boss portion 23*a* of the hour printing wheel 23 and adapted to rotate integrally therewith for driving the hour printing wheel 23. As shown in FIG. 3, twenty four pieces of ratchet teeth provided on the peripheral surface of the ratchet wheel 25 are disposed in engagement with a reverse motion preventing pawl 26 and a feed pawl 27. The feed pawl 27 is pivotally supported for swinging movement by an arm end 28*b* of a feed lever 28 pivotally supported by a fixed shaft 29. By a swing movement of a cam follower 28*a* at the other end of the feed lever 28 due to the sliding movement of the cam follower 28*a* along the peripheral surface of a comma-shaped cam 22*a* integral with the minute printing wheel 22, the ratchet wheel 25 is pawl-fed one step each hour, and thereby the hour printing wheel 23 integral therewith is fed one step in the clockwise direction in the drawing.

Figure 4:
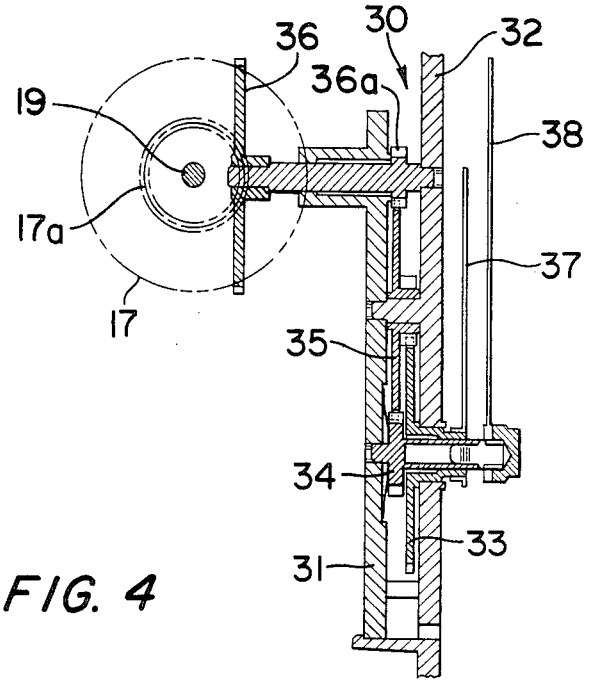
FIG. 4 is a sectional view showing a transmission mechanism.

On the other hand, on the plane in parallel with the paper surface of FIG. 1 that is, one the plane perpendicular to the front plate 1 and the back plate 2, there is provided a clock front plate 31. FIG. 4 shows the transmission mechanism 30 provided on the clock front plate 31, and in the space between the clock front plate 31 and a clock face 32 provided in front of the front plate 31, there is disposed a transmission wheel 35 in engagement with an hour-hand wheel 33 and a minute-hand pinion 34, and the transmission wheel 35 is further coupled through a pinion 36*a* with an intermediate transmission wheel 36 in engagement with a crown gear wheel 17*a* integral with the minute reduction wheel 17 (FIG. 1), and thereby, the transmission wheel 35 is adapted to transmit the rotations of the minute reduction wheel 17 in the ratio of 1:12 to an hour hand 37 and to a minute hand 38.

Figure 5:
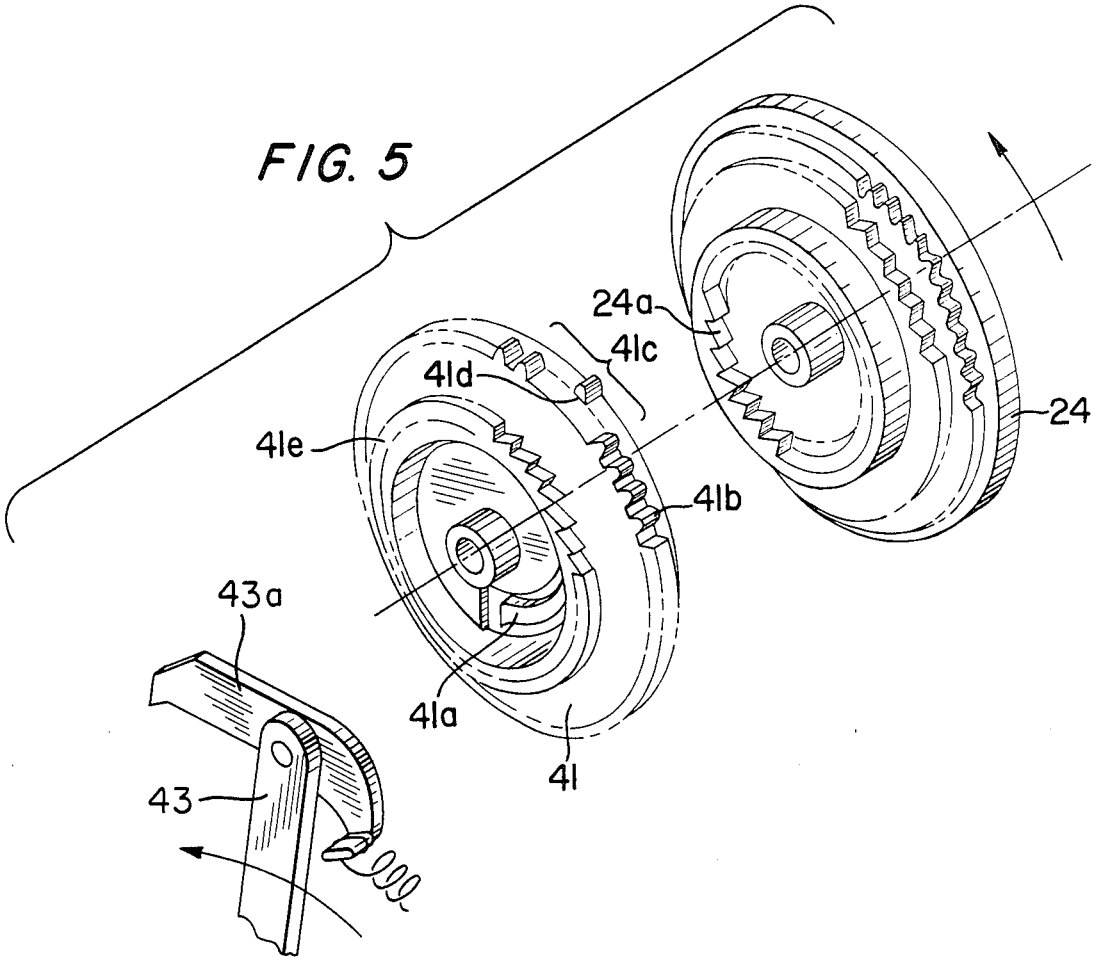
FIG. 5 is a perspective view showing a date printing wheel and a first step-feed wheel.

Describing now the card feed mechanism 40 which is driven by the driving force supplied from the date printing wheel 24, a first step-feed wheel 41 constituting the card feed mechanism 40 is disposed on the printing wheel shaft 21 adjacent to the date printing wheel 24. As shown in FIG. 5, the end of a cantilever-shaped pawl piece 41*a* formed by punching on the face of the first step-feed wheel 41 is disposed in engagement with ratchet inner teeth 24*a* formed on the side face of the date printing wheel 24, whereby the first-step feed wheel 41 is driven, as the date printing wheel 24 rotates in the direction indicated by the arrow in the drawing once a day, to move one step in the same direction.

Figure 6:
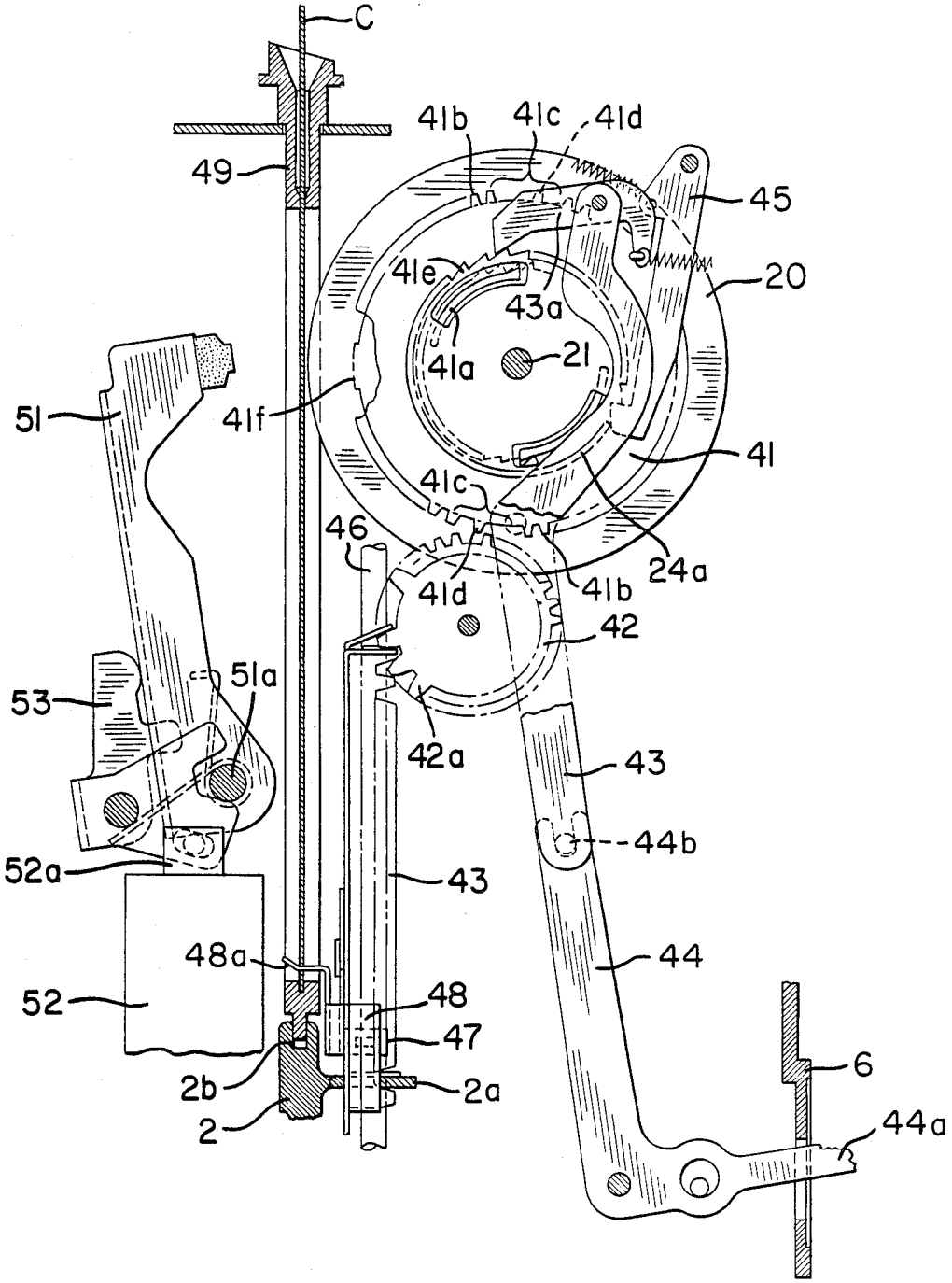
FIG. 6 is a side view showing a card feed mechanism.

While, as shown in FIG. 6, the first step-feed wheel 41 is in engagement with a second step-feed wheel 42 for stepwisely f-eding a rack bar 43, the toothed gear 41*b* provided on the periphery of the first step-feed wheel 41 is divided into a 15-tooth portion and a 16-tooth portion by two toothless portions 41*c*. On these toothless portions 41*c*, there are provided thick wall projections 41*d* (FIG. 5), and therefore, as the second step-feed wheel 42 has made 15 or 16 steps of rotation, i.e., a half-month rotation, the second step-feed wheel 42 is disengaged from the first step-feed wheel 41 at these toothless portions 41*c*, and allows the step-fed rack bar 43 to fall downwardly by its own weight, and, by next stepwise feeding movement of the first step-feed wheel 41, the second step-feed wheel 42 is brought again into engagement with the following toothed portion 41*c* by means of the thick wall projection 41*d*.

Figure 10:
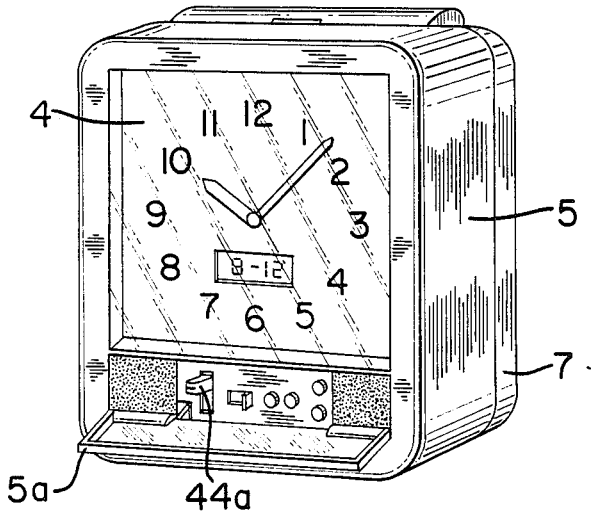
FIG. 10 is an external view of a time recorder.

The first step-feed wheel 41 is further provided with a ratchet wheel 41*e* integrally formed on one side thereof. By operating a set lever 43 to be discussed later, the rotating force is given by a feed pawl 43*a* at the top end thereof to the first step-feed wheel 41 and allows the same to rotate irrespective of the date printing wheel 24 while the cantilever-shaped pawl piece 41*a* is allowed to slide on the ratchet inner teeth 24*a*. The above mentioned set lever 43 is pivotally supported by the back plate 2 for the swinging movement as shown in FIG. 6 and its lower end is connected through a pin 44*b* with one end of an operating crank lever 44, the other end 44*a* thereof protruding out of the lower portion of the front frame 5 of the main body 4 (FIG. 10), whereby the first step-feed wheel 41 is rotated step by step by vertically operating the operating lever 44 from the front of the main body 4.

Incidentally, reference numeral 41*f* denotes an index mark provided on the peripheral surface of the first step-feed wheel 41 for enabling it to be detected through an opening 7*a* (FIG. 8) in the rear frame 7 of the case to indicate which of the first half mouth portion and the latter half mouth portion of the first step-feed wheel 41 is selected, and 45 denotes a reverse motion preventing pawl to engage with the pawl of the ratchet wheel 41*e*.

Figure 7E:
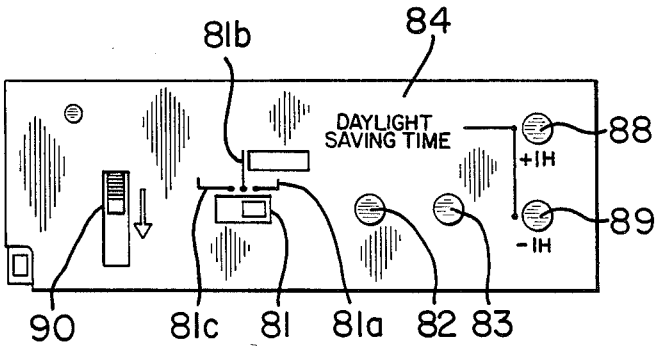
FIG. 7E is a front elevational view of a correcting device of FIG. 6E.
Figure 7:
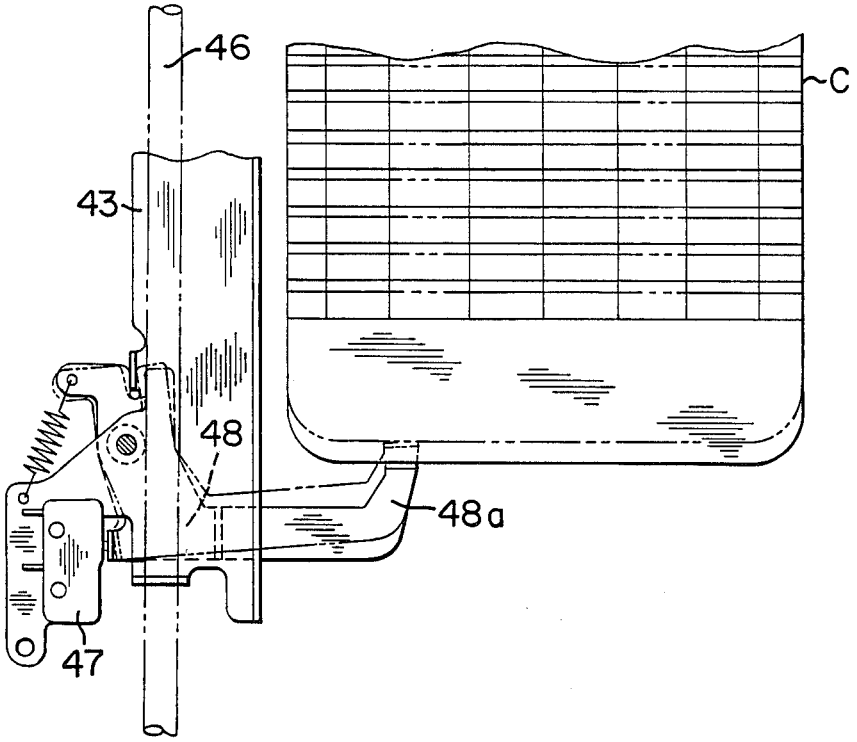
FIG. 7 is a front view of the above mechanism.

The rack bar 43 in engagement with the rack feed gear wheel 42*a* of the second step-feed wheel 42 is, as shown in FIGS. 6 and 7, driven to move up and down along a guide shaft 46. The rack bar 43 is provided with a card detecting switch 47 close to its lower end to abut on a stopper 2*a* protruded from the back plate, and it detects whether the card c is inserted or not by means of a swingable switch lever 48, and one end 48*a* thereof is arranged to intersect the insertion path of the card c.

Figure 8:
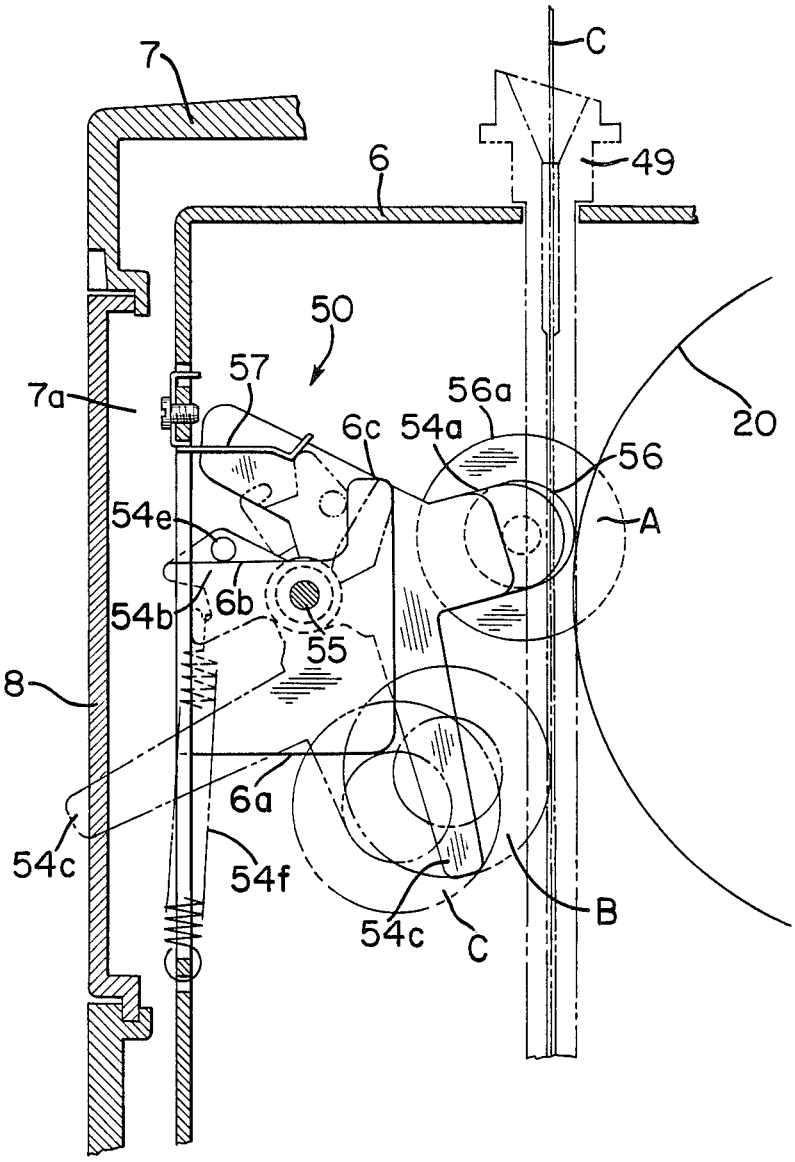
FIG. 8 is a side view showing a print mechanism.

FIGS. 6 and 8 show the print mechanism 50 provided within the main body at the rear portion. Close to the backside of the printing wheel assembly 20, there is provided a card guide 49 for guiding a card inserted from above the main body 4, the card guide 49 being mounted within a guide groove 2*b* in the back plate 2 and being driven to move along the peripheral surface of the printing wheel assembly 20 in its axial direction. In the back of the card guide 49, there is disposed a hammer 51 rotating about a pin 51*a* serving as its fulcrum, with its front end positioned in the vicinity of the portion where the peripheral surface of the printing wheel assembly 20 abuts on the card c. The hammer 51 is adapted to be driven by a solenoid 52 which is actuated according to the card detecting switch 47 through a swing lever 53 coupled with a plunger 52*a* of the solenoid 52.

Figure 9:
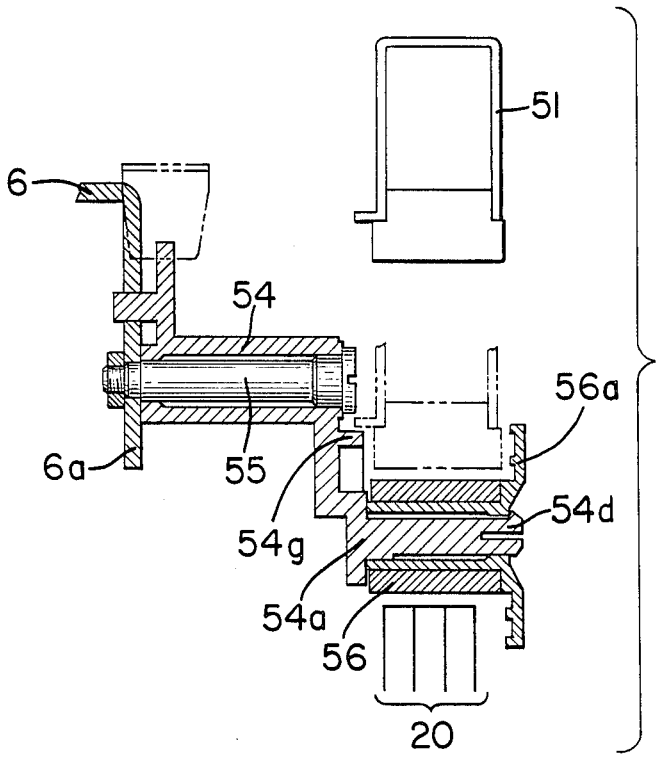
FIG. 9 is a sectional view showing an ink roller portion.

On the other hand, in the position opposed to the printing wheel assembly 20 across the card c, there is disposed a roller lever 54 for supplying ink to the printing surface of the printing wheel assembly 20, the roller lever 54 being pivotally supported through a pin 55 on a bracket 6*a* of a frame 6. The lever 54 is, as seen from FIG. 8, made up of a first arm 54*a* for supporting an ink roller 56, a second arm 54*b* provided with a pin 54*e* to abut on the upper edge 6*b* and rising edge 6*c* of the bracket 6*a*, and a third arm 54*c* which is protruded out of the opening 7*a* of the rear frame 7 of the case when the lever is rotated for exchanging the ink roller 56. As shown in FIG. 9, the ink roller 56 having a large-diameter roller 56*a* on its one end is removably set on a pin 54*d* embedded in the first arm 54*a* and the ink roller 56 is urged in a direction opposite to the inserting direction of the card c by means of a spring 54*f* acting on the second arm 54*b* and held to oppose the printing wheel assembly 20 with a certain space left therebetween.

Incidentally, reference numeral 8 in FIG. 8 denotes a lid member to cover the opening 7*a* in the rear frame 7 of the case, 57 denotes an engagement piece for engaging with the roller lever 54 when the same is in the position enabling the ink roller to be exchanged, and reference numeral 54*g* in FIG. 9 denotes an engagement protrusion adapted to engage with a protrusion 51*b* provided at the front end of the hammer 51 thereby to prevent the hammer 51 from making a printing operation when no card is inserted.

Operations of the apparatus of the above described structure will be described in the following.

Driving the printing wheel assembly and card feed mechanism

When the step motor 19 rotates in the forward direction in response to a signal output each minute from a clock curcuit 62*a* (FIG. 11), the clutch wheel 12 is rotated through the pinion 19*a* in the clockwise direction in FIG. 2, whereby the minute printing wheel 22 is rotated one step through the minute clutch wheel 13 and minute reduction wheel 17. At the time the rotation is made when the type of the minute printing wheel 22, opposing the hammer 51, indicates "59", the cam follower 28*a* is caused to fall off the stepped portion of the cam 22*a* integrally rotating with the minute printing wheel 22, whereby the feed lever 28 is pivotably moved, the ratchet wheel 25 is allowed to be fed one tooth by the feed pawl 27 at its end, and the hour printing wheel 23 integrally rotating with the ratchet wheel 25 is rotated to make a one hour increment.

On the other hand, this rotation is transmitted by the intermediate transmission wheel 36 in mesh engagement with the crown gear wheel 17*a* of the minute reduction wheel 17 to the transmission wheel 35, whereby the minute hand 38 and hour hand 37 are advanced to the portions corresponding to one minute.

If the current time becomes 0:00 A.M., then, after the above mentioned operations have been made, a low-frequency reverse pulse signal which is just enough to rotate the clutch wheel 12 more than one pawl portion of the clutch pawl of the minute clutch wheel is output and, in succession thereto, pulses of the opposite phase corresponding to the above mentioned extra pulses are output from the clock circuit 62*a*. Thus, the step motor 19 is made to rotate in the direction reverse to the original direction, causing the clutch wheel 12 in mesh engagement with the pinion 19*a* to rotate reversely and slip over a pawl of the minute clutch wheel 13 irrespective of existence of a backlash, and then the clutch wheel 12 is caused to rotate in the positive direction, whereby the pawls of the cluthc wheel 12 and the date clutch wheel 15 are joined together and the date clutch wheel 15 which has been stationary up to that time is rotated by means of the clutch pawls provided on the date feed cylinder 12*a*, and the date printing wheel 24 is advanced a one-day step through the date reduction wheel 18.

At the end of the month ending on 30th or 28th, the step motor 19 s continuously rotated to correct for the difference between the days of the month and 31 days in response to a signal stored in a ROM 62*c* or the like, and thereby, the date is set to the first of the following month.

In the meantime, when the date printing wheel 24 is rotated, it causes the first step-feed wheel 41 to rotate through its pawl piece 41*a* in engagement with the ratchet inner tooth 24*a* of the wheel 24, and thereby, the rack bar 43 is elevated one row interval of the card c through the rack feed gear wheel 42*a* of the second step-feed wheel 42 in engagement with the wheel 41. If the rack bar 43 is elevated to the highest position through the repetition of such movements for fifteen times in the first half of the month or for sixteen times in the second half of the month, then the second step-feed wheel 42 is brought into contact with the toothless portion 41*c* of the first step-feed wheel 41 to be rotated idle, and thereby, the rack bar 43 is allowed to fall downwardly by its own weight to return to the lowest position.

Recording the time in the card

While the above described operations are made, the roller lever 54 is, as shown by the solid line in FIG. 8, rotated in the counterclockwise direction in the drawing urged by the spring 54*f*, with the pin 54*e* abutted on the upper edge 6*b* of the bracket 6*a*, thereby to hold the ink roller 56 in the position opposed to the printing wheel assembly 20 with a certain space left therebetween (position A).

In the described state, if the card c is inserted through and guided by the card guide 49 projecting from the top of the main body 4, the card c pushes with its lower end the large-diameter roller 56*a* provided at one end of the ink roller 56 thereby causing the roller lever 54 to rotate clockwise into the position B in the drawing, and allowing the ink roller 56 to touch the peripheral surface of the printing wheel assembly 20, and thereafter the card c reaches the bottom end of the rack bar 43 and pushes one end 48*a* of the switch lever 48 stuck out there to turn ON the card detecting switch 47.

The solenoid 52 is thereby actuated to rotate the hammer 51 in the clockwise direction in the drawing through the swing lever 53 so that the front end of the hammer cam strike the backside of the card c thereby to cause its front surface to be brought into abutment with the peripheral surface of the printing wheel assembly 20 and the date, hour, and minute at that time is printed on the card c.

Adjustment of the recording device

It is sometime required for the accounting reason to start recording from the 20th, for example, of the month, different from the usual practice starting at the beginning of the month. In such a case, the lid 5*a* provided at the lower portion of the front frame 5 (FIG. 10) will be opened and the end 44*a* of the operating crank lever 44 protruding there will be operated vertica-ly so that the set lever 43 coupled with the crank lever 44 through the pin 44*b* (FIG. 6) can be swung and the ratchet wheel 41*e* can be pawl-fed by the pawl 43*a* at the front end thereof. Thus, the first step-feed wheel 41 integral with the ratchet wheel 41*e* is made to rotate relative to the date printing wheel 24 with the pawl piece 41*a* allowed to slide on the ratchet inner teeth 24*a*, whereby the rack bar 43 is elevated step by step through the second step-feed wheel 42 in engagement therewith, and thus, it is made possible to start the recording from the designated date in the card c.

And, when it is required to record the leaving time in vertically divided sections in the card c according to such divisions as forenoon, afternoon, and overtime, the card guide 49 will be shifted horizontally along the guide groove 2*b* in the back plate 2 so that the portion in the card of the designated time zone can come in abutment with the printing wheel assembly 20.

Replacing the ink roller

In the case the ink impregnated in the ink roller 56 is dried after long use, the lid member 8 on the rear frame 7 of the case will be opened and the roller lever 54 is rotated in the clockwise direction in the drawing until the pin 54*e* thereon is brought into abutment with the rising edge 6*c* of the bracket 6*a*. Since, by so doing, the second arm 54*b* is brought into engagement with the engagement piece 57 fixed on the frame 6 and the ink roller 56 is brought to the vicinity of the opening portion 7*a* (position C in FIG. 8), the ink roller 56 can be replaced in this position.

In this position, the third arm 54*c* is protruded out of the opening portion 7*a* as indicated by the two-dot chain line in FIG. 8. By closing the lid member 8 after the above described replacement, the third arm 54*c* is pressed inward by the lid member 8 and the roller lever 54 is rotated in the counterclockwise direction in the drawing and returns to the position A in FIG. 8 with the ink roller 56 brought into abutment with the printing wheel assembly 20.

What has been made in the foregoing is the descriptions of the driving force transmission mechanism and of the time recorder provided with such a mechanism, but the means for the transmission of rotation from a rotating member coupled with a driving power source such as a step motor to a recording member recording the time of hours and minutes and to a recording member recording the date can be constituted by other mechanisms than the above described clutch mechanism.

Namely, the rotation transmitting member for recording the time of hours and minutes and the rotation transmitting member for recording the date, both of which are arranged against the rotating member coupled with the rotating power source may be, respectively, coupled with this rotating member through such known mechanisms as spring clutches, overriding clutches, or the like which are designed to transmit rotation only in the directions opposite to each other.

Now, the drive circuit for controlling the above described operations of various mechanisms will be described in the following.

Figure 11:
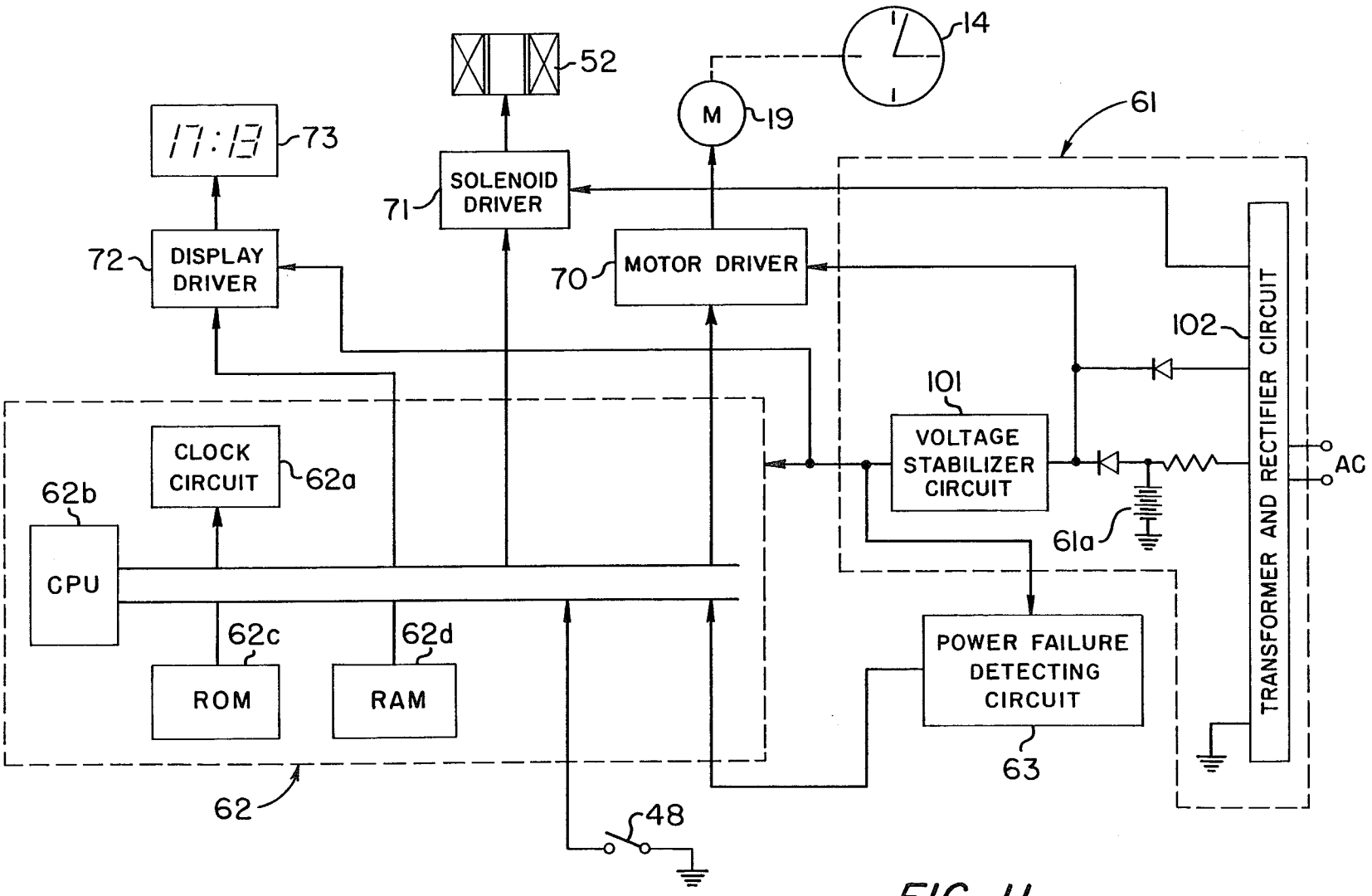
FIG. 11 is a block diagram showing an embodiment of the drive circuit for controlling the printing wheel assembly.
Figure 12A:
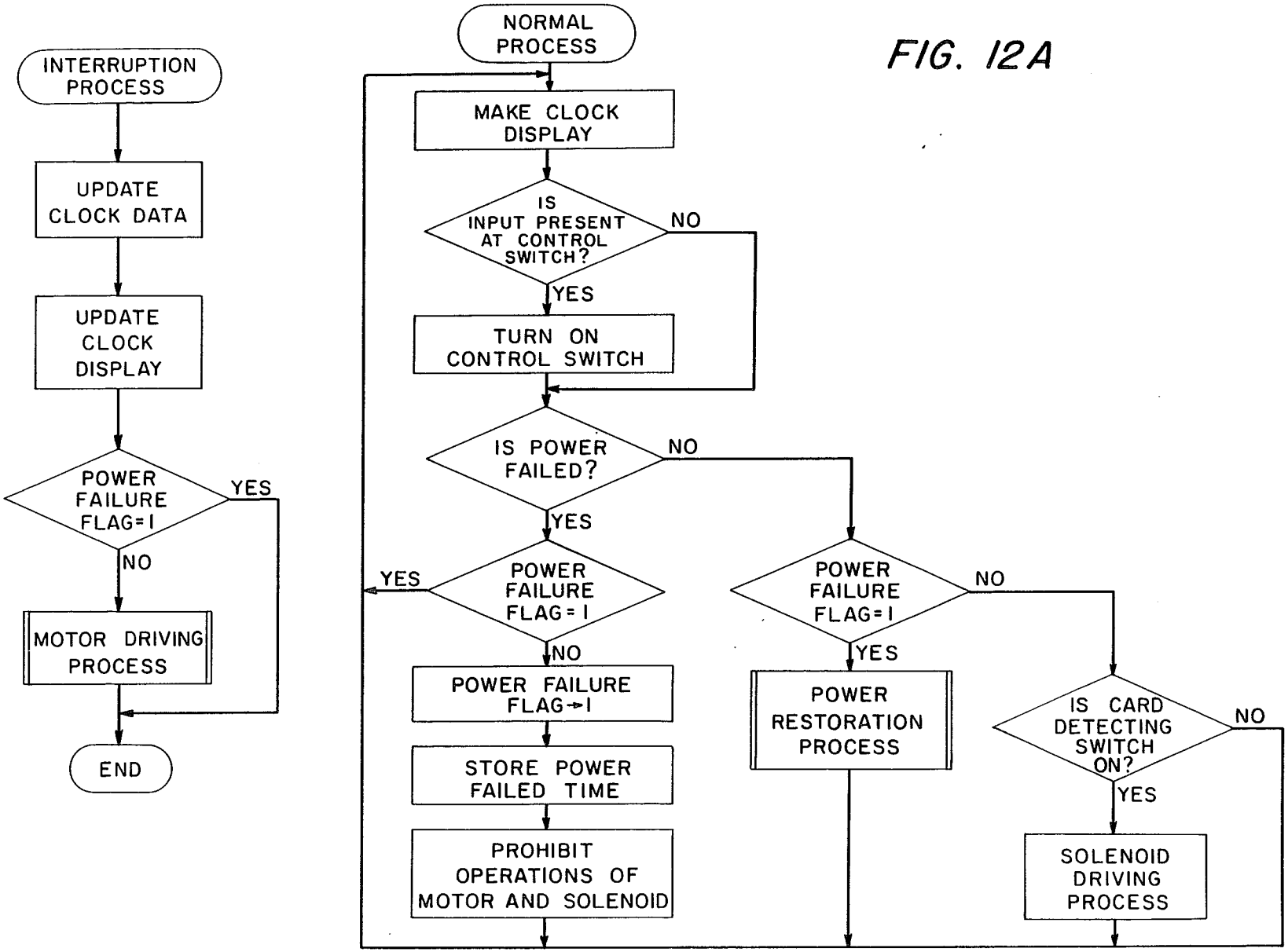
FIGS. 12A, 12B, 13A and 13B are flow charts showing operations of the drive circuit of FIG. 11.
Figure 12B:
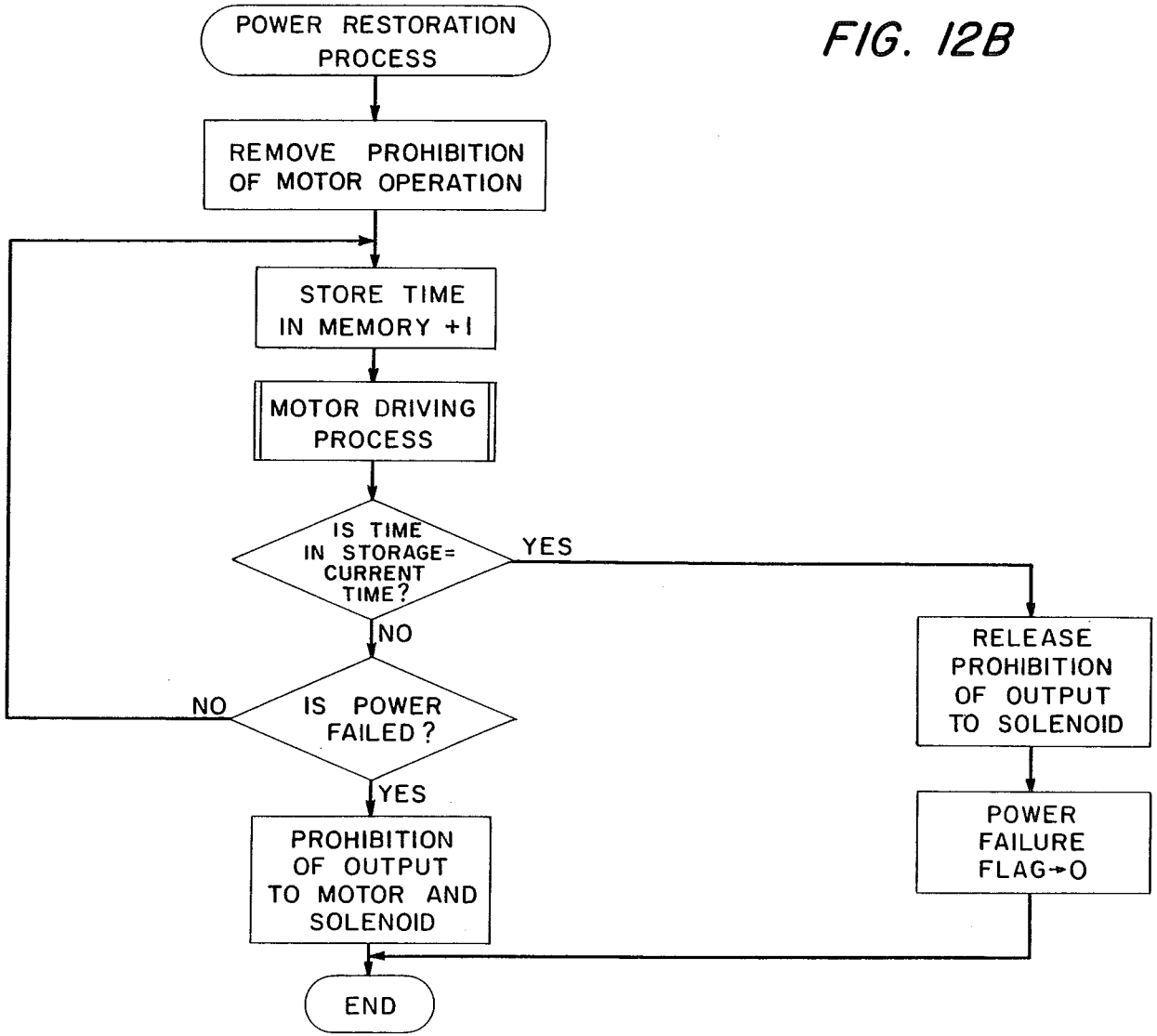
Figure 13A:
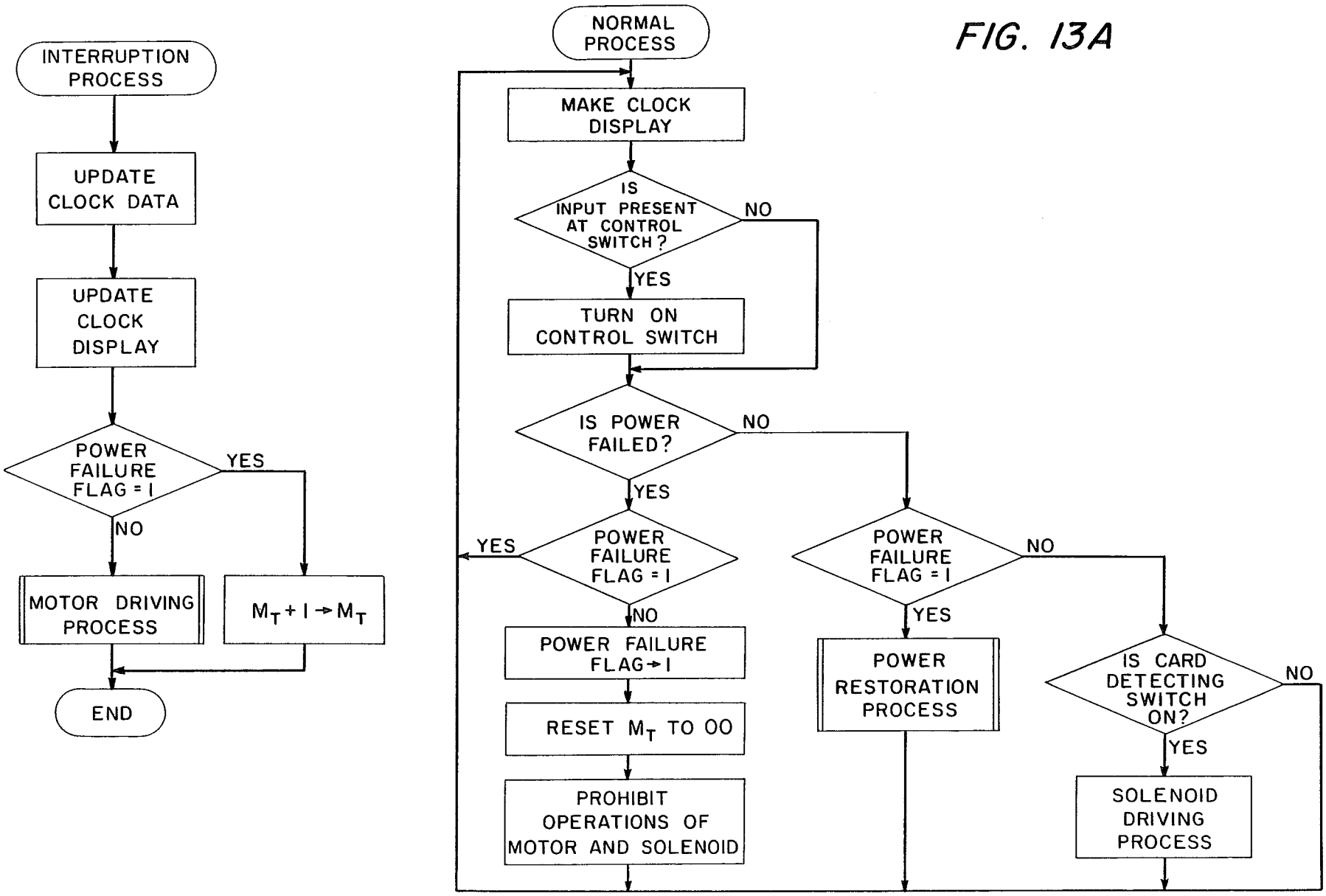
Figure 13B:
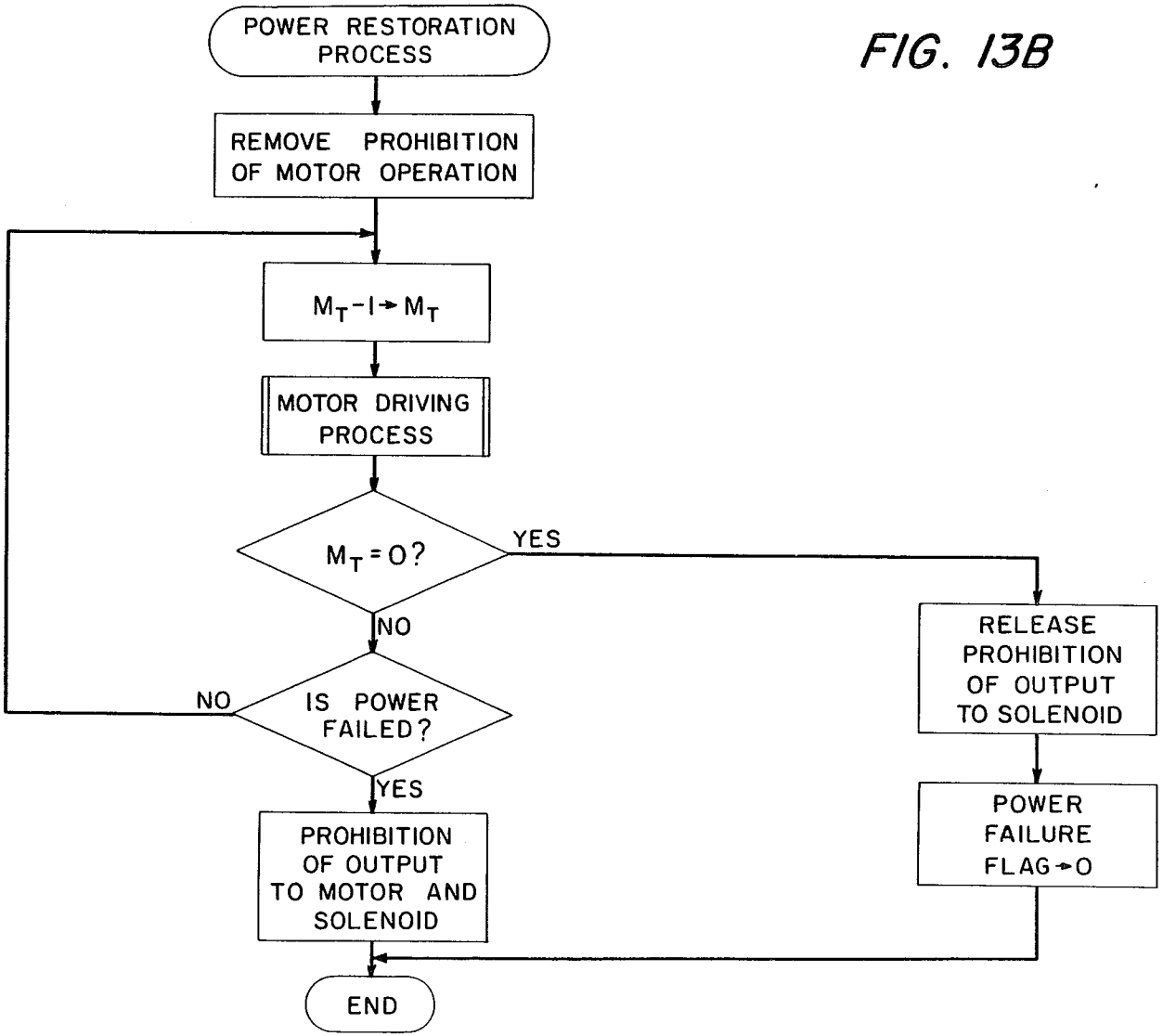

FIG. 11 shows an embodiment of the drive circuit, which is comprised of a power supply portion 61, control portion 62, and power failure detecting portion 63. The power supply portion 61 is adapted to rectify the commercial power and supply drive power to a motor driver 70 and a solenoid driver 71, and on the other hand, while charging a secondary battery 61*a* in a floating state, to supply operating power to the control portion 62 and a display driver 72. The control portion 62 is made up of the clock circuit 62*a* for generating a clock timing signal, CPU 62*b*, ROM 62*c* storing control programs for controlling operations of the CPU 62*b*, and RAM 62*d* for storing the time when a power failure has started. The control portion 62 is adapted so as to receive signals from the card detecting switch 48 and power failure detecting circuit 63 and delivers the timing control signal to the display driver 72 and the motor 70 and a printing command or control signal to the solenoid driver 71.

Now, operations of the apparatus of the above described structure will be described below according to a flow chart shown in FIGS. 12A, 12B, 13A and 13B.

Figure 14:
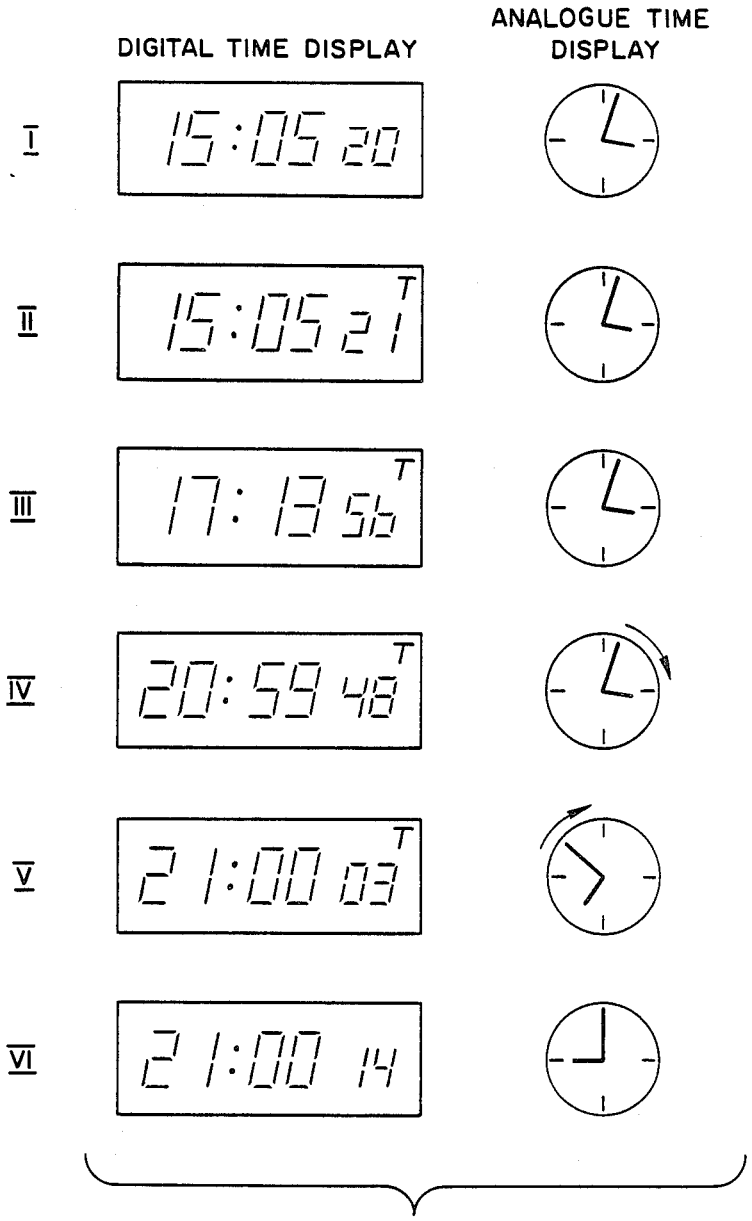
FIG. 14 is an explanatory drawing showing operations of the above circuit.

When the power supply portion 61 is in connection with the commercial power source, the power failure detecting portion 63 outputs an L level signal and the power supply portion 61 supplies the operating power. The clock circuit 62*a* delivers the timing control signal to the display driver 72 and motor driver 70 to drive the digital display and the pulse motor 19 so that the analog clock 14 and the minute printing wheel 22 can be rotated to set the time at the turn of every minute (FIG. 14 I).

At this time, if the time card is inserted, the CPU 62*b* responsive to a signal from the card detecting switch 48 actuates the solenoid driver 71 to drive the solenoid 52 so that the date and time are printed in a specific or designated section of the card by the printing hammer 51.

If, under these conditions, the supply of the commercial power is suspended by power failure or the like, the control portion 62 continues its operations with electric power supplied from the back-up secondary battery 61*a*. On the other hand, by the suspension of the commercial power supply, the power failure detecting circuit 63 reverses its output to H level. The CPU 62*b* responsive to the H level signal stores the time of the clock circuit 62*a*, i.e., the time the power failure starts, in RAM 62*d*, makes an indication "T" for power failure to be displayed in one corner on the digital display 73 (FIG. 14II), and at the same time, blocks the delivery of the drive signal from the solenoid driver 71 and the motor driver 70. Therefore, even if the timing signal or printing command signal is output from the control portion 62, the motor driver 70 and solenoid driver 71 are disabled so that wasteful consumption of power of the back-up secondary battery 61*a* is prevented. In the meantime, the control portion 62 including the clock circuit 62*a* is supplied with the electric power from the back-up battery 61*a* of the power supply portion 61 and continues time counting operation the same as before the power failure has occurred and makes the current time displayed on the digital display 73 (FIG. 14III).

In such a state of the power failure, if the commercial power is recovered and the commercial power is again supplied to the apparatus, the power failure detecting circuit 63 reverses its signal to the L level and delivers the signal to the control portion 62. The PCU 62*b* releases the disabled state of the motor driver 70 and supplies this motor driver 70 with a quick pulse control signal at a higher frequency than the normal timing control signal and, at the same time, adds to the power failure starting time data stored in the RAM 62*d* the time value counted by the pulse signal with regarding the same as the normal timing control signal. The motor 19 responsive to the high frequency pulse signal quickly feeds the analog time display mechanism 14 and the printing wheel assembly 20 (FIG. 14 IV and V). When, through the continuance of such operations, the sum of the power failure starting time data and the added time value based on the pulse signal coincides with the present time data of the clock circuit 62*a*, the delivery of the pulse signal for the quick feed is stopped and simultaneously the solenoid driver 71 which has been disabled during that time interval is enabled. Thereby, the displayed time on the analog time display mechanism 14 and the date, hour and minute printing wheels of the printing wheel assembly 20 are automatically corrected to the current time (FIG. 14 VI).

Although the time when the supply of the commercial power supply is suspended is stored in the RAM 62*d* in the above described embodiment, of course, the same effect is obtained if the time from the start of the power failure to the power recovery, and the time required for the time correction, that is, the time from the power failure to the completion of the correction, is accumulated as shown in FIG. 13, and the pulses of the number corresponding to this accumulated time are delivered.

According to the present invention, as described so far, means for transmitting rotation to recording means for recording the time of minutes and hours and means for transmitting rotation to recording means for recording the date are coupled, through separate driving systems for transmitting rotation only in the directions opposite to each other, with a rotating member coupled with a driving power source, and so, the means for transmitting rotation once a day to the date printing wheel mechanism and the card step feed mechanism requiring rather large rotational driving force can be driven separately from the means for rotating the transmitting means operating minutely and hourly. Therefore, application of excessive force to driving force transmitting mechanisms can be avoided and durability of the apparatus can be improved. Besides, the correction mechanism for correcting the date printing wheel and card feed mechanism according to whether the month is of 31 days or not and the manner of the usage of the card can be greatly simplified.

Now, details of the present invention will be described based on the second embodiment in the following.

Figure 1B:
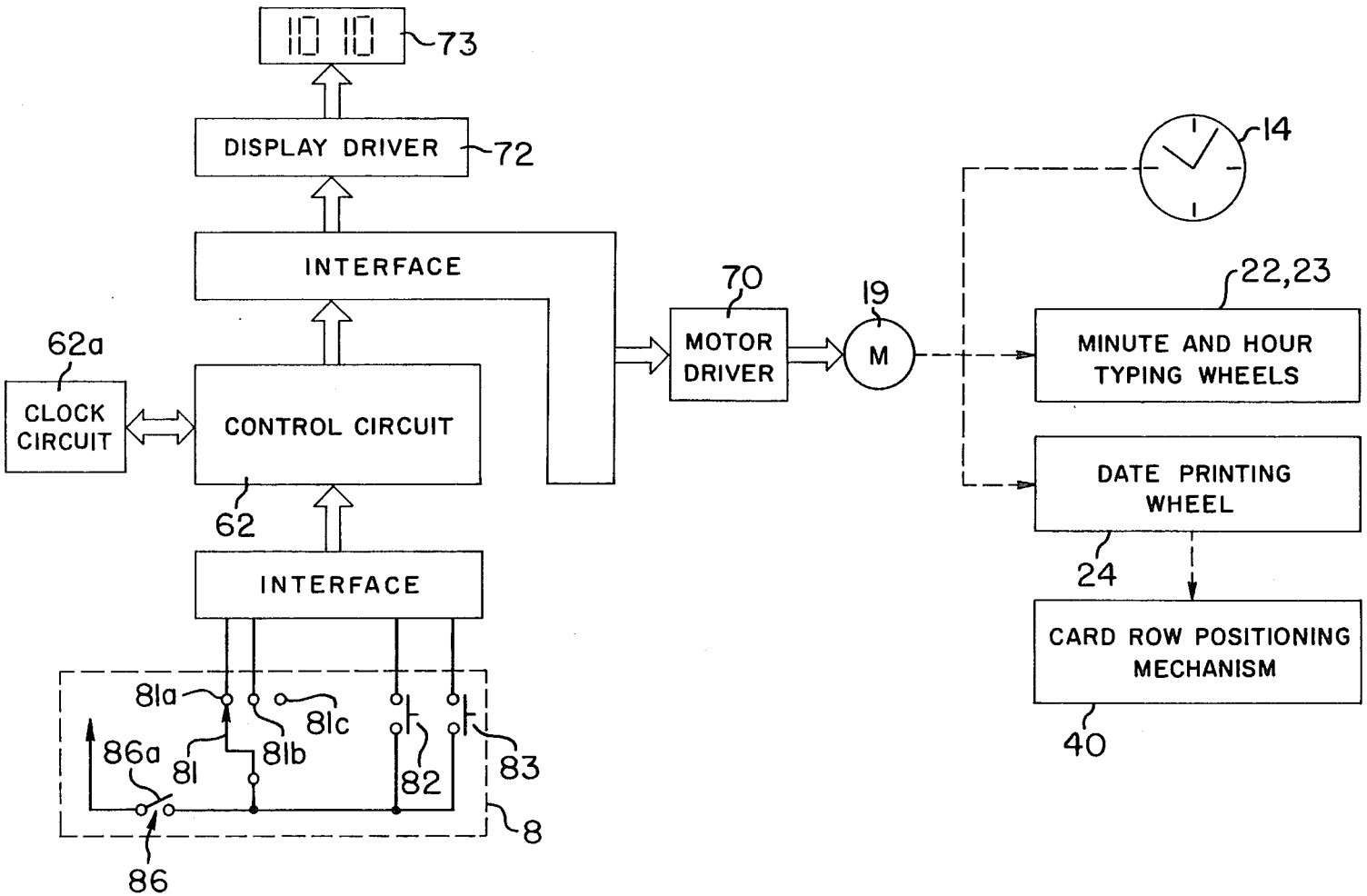
FIG. 1B is a block diagram of the apparatus indicating the second embodiment of the present invention.

FIG. 1B shows the second embodiment of the present invention, wherein reference numeral 62*a* denotes a clock circuit formed of a reference oscillator, frequency divider, and others adapted to output a clock timing signal. Reference numeral 62 is a control circuit formed of a CPU and others, and the same is adapted, responding to the clock timing signal from the clock circuit 62*a*, to operate a digital display 73 through a display driver 72, to drive a pulse motor 19 through a motor driver 70 thereby to drive a minute-hand 38 and an hour-hand 27 of an analogue display mechanism 14 and to drive a minute and hour printing wheels 22, 23 and a date printing wheel 24 as well as a card row positioning mechanism 40. The pulse motor 19 is further driven to selectively correct the contents of the display on each display mechanism according to a correction signal from a later discussed time correcting portion 8.

Figure 5B:
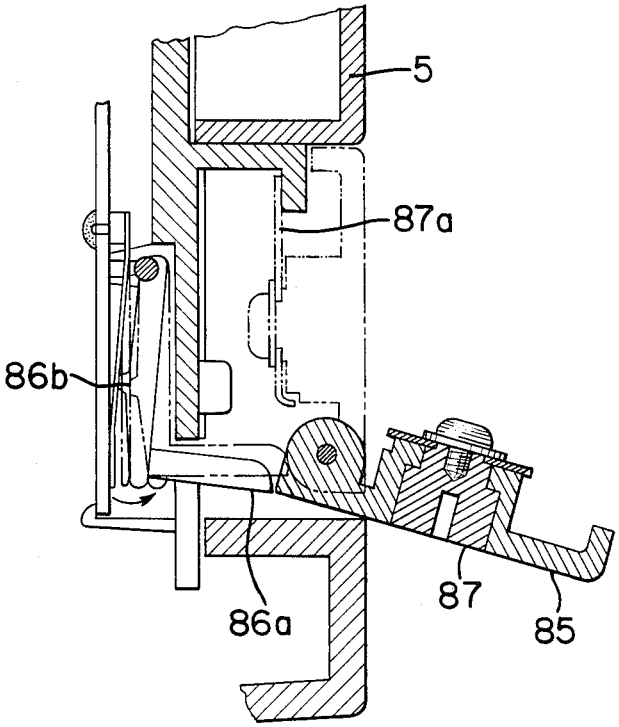
FIG. 5B is a sectional view showing an embodiment of a lock mode reset switch.

The correcting portion 8 is made up of a mode switch 81 formed of a three-contact switch having three contacts 81*a*, 81*b* and 81*c* and two pushbutton switches 82 and 83 collectively arranged on a panel 84, located at the lower portion of the case 5, as shwon in FIGS. 3 and 4, normally covered by a front lid 85, the case having a time printing mechanism and the above described circuitry housed therein and an analog display mechanism 14 and a digital display 73 disposed on its front face. The mode switch 81 is connected through a later discussed lock mode reset switch 86 to a signal source (not shown) and the selection among analog mode, digital mode, and lock mode is possible by the use of the mode switch 81. The pushbutton switches 82 and 83 are a select button and a set button, respectively. The above mentioned lock mode reset switch 86 is formed of a switch, whose operating rod 86*a*, as shown in FIG. 5B, abuts against the front lid 85 for the panel 84 on which the correcting switches are disposed, and a contact 86*b* of the lock mode reset switch 86 can be turned ON when the front lid 85 is opened and the same can be turned OFF when the lid is shut or closed. Incidentally, 87 denotes a lock provided in the front lid 85, and the lid 85 is opened by disengaging an engagement piece 87*a* with a key, whereby unwanted operation of the correcting switches, etc. is prevented. The correcting portion 8 further includes a switch 90 for setting a closing date.

Figure 2B:
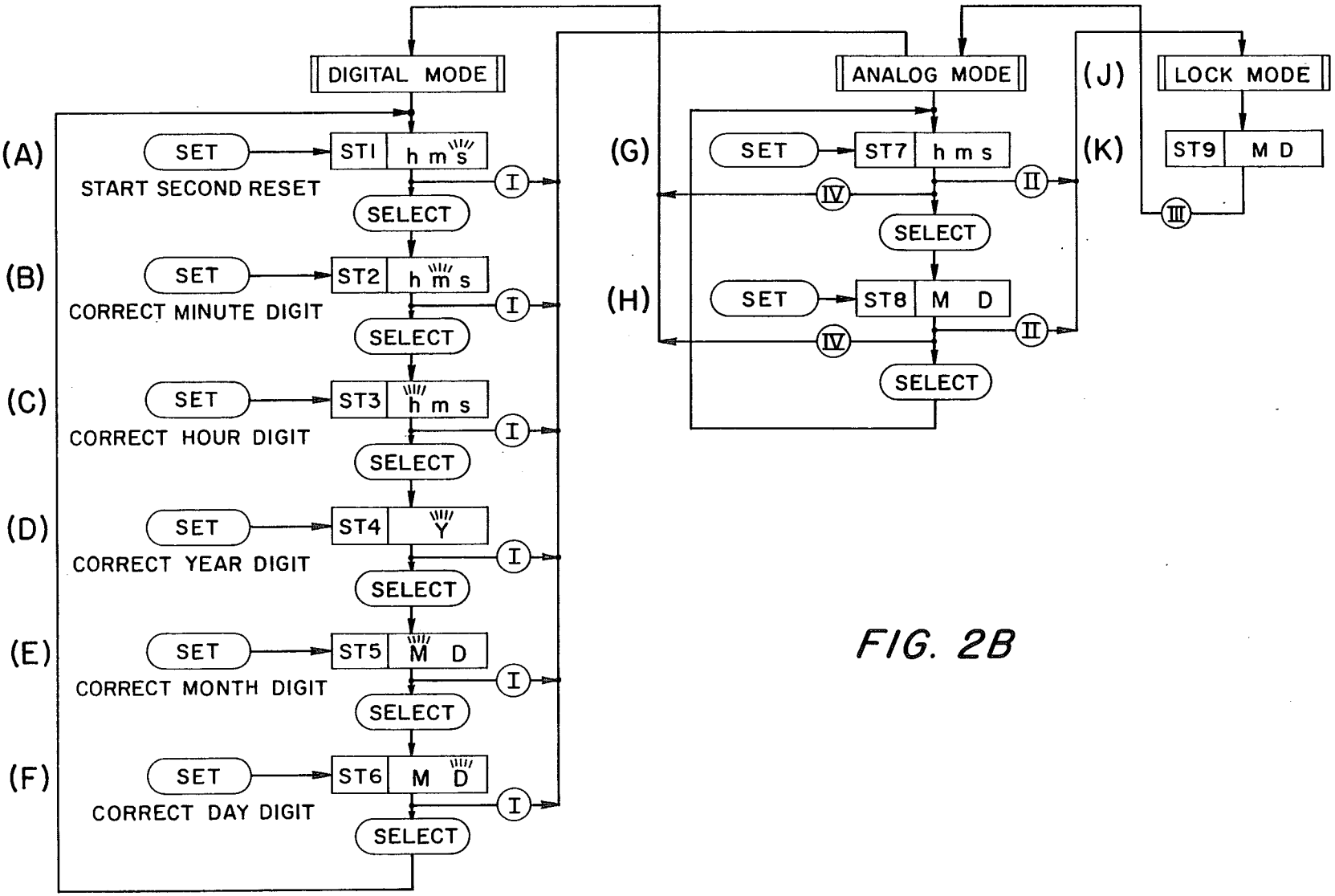
FIG. 2B is an explanatory flowchart describing operations of the above apparatus.

Now operations of the apparatus of the above described construction will be described in the following based on a mode transition flow chart of FIG. 2B.

If the front lid 85 is opened in order to correct the contents of the digital display 73 and the analog display mechanism 14, then, the lock mode reset switch 86 is turned ON through its operating rod 86*a* abutting against the lid, and thereby, an operating signal is applied to the mode switch 81. Since, at this time, the lock mode is selected by the mode switch 81, there is a display of the month and date on the digital display mechanism 73.

Under these conditions, if the digital mode is selected by sliding the modeswitch 81 from the contact 81*a* to the contact 81*b*, the hour, minute, and second (h,m,s) appear on the digital display 73 with the numeral for the second s flashing to indicate that the correction of the second is possible (A). If the set button 83 is pushed in this condition, the display for the second is corrected accordingly. If then the select button 82 is pushed, the digit for the minute m flashes and it becomes possible to correct the minute (B), and the numeral representing the minute is advanced one by one each time the set button 83 is pushed. If the select button 82 is pushed when the correct numeral for the minute has been obtained, it becomes possible to correct the hour h, and thereafter, the digit for the minute is advanced in synchronism with a signal from the clock circuit 62*a*. In a similar manner, each time the select button 82 is pushed, the objects of correction are changed in the order of second minute→hour→year (D)→month (E)→day (F) and returns to the original state (A). Thus, the correction of the digits can be made in a cyclic manner.

Then, if the analog mode is selected by shifting the mode switch 81 to the contact 81*c* (I), there appears the correct time of the hour, minute, and second, that were corrected just before, on the digital display 73 (G). If, under these conditions, the set button 83 is pushed, pulses of the number corresponding to one minute are input to the pulse motor 19, and thereby, the minute hand 38 and hour hand 37 of the analog display mechanism 14 and the printing wheels 22, 23 are made to advance one step corresponding to one minute.

If the select button 82 is pushed when the analog display mechanism 14 as well as the printing wheels 22 and 23 interlocked therewith have been set to the right time by the set button 83 pushed by the required number of times, the display on the digital display 73 is switched from that of the hour, minute, and second to that of the month and day (M, D) and simultaneously the date printing wheel 24 becomes ready for correction (H). If, under these conditions, the set button 83 is pushed, the pulse motor 19 is rotated reversely, whereby only the date printing wheel 24 is rotated through the clutch mechanism 10 to be put in engagement in the reverse rotation.

When all these corrections have been finished, if the mode switch 81 is returned to the lock mode (II), the signal input to the mode switch 81 is cut off and the cut-off is detected by the control circuit 62, and so, the clock timing signal from the clock circuit 62*a* is input to the motor driver 70, whereby the analog display mechanism 14 and the printing wheels 22, 23 and 24 are made to advance according to the lapse of time, while the digital display 73 is made to display the month and day (K).

If, on the other hand, the front lid 85 of the panel 84, when the time corrections have been finished, is shut without returning the mode switch 8 to the lock mode, the lock mode reset switch 86*a* is switched from ON to OFF by the movement of the front lid 85, and therefore, the signal input to the mode switch 81 is cut off. Thereby, the control circuit 62 outputs the timing control signal from the clock circuit 62*a* to the motor driver 70 to make the analog display mechanism 14 and the printing wheels 22, 23 and 26 advance according to the lapse of time and simultaneously makes the month and day displayed on the digital display 73 (K), and at the same time, the switch 81 is isolated from the external circuit and entry of external noise is checked, and thus, malfunction can be prevented from occurring.

Figure 6B:
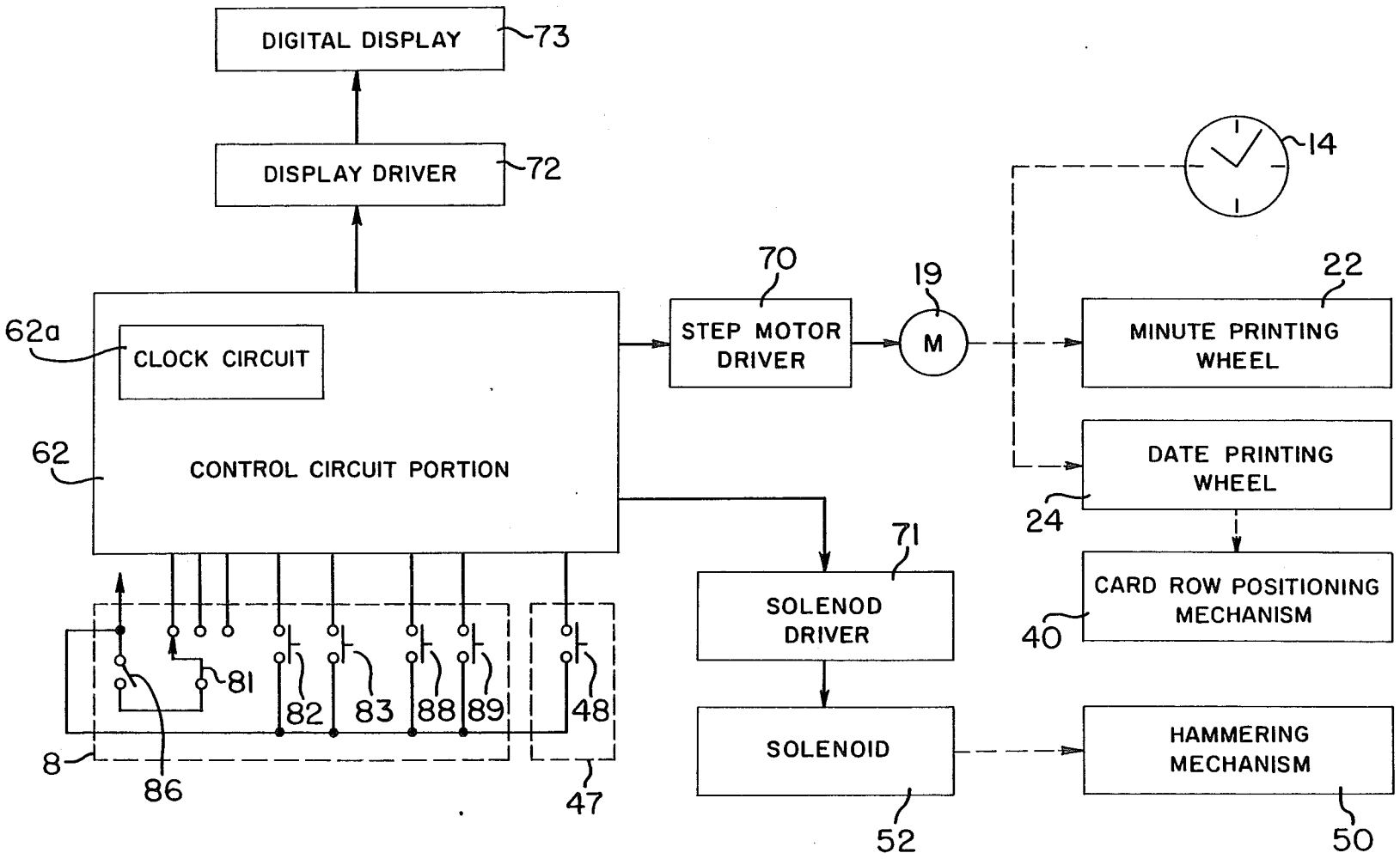
FIG. 6B is a circuit block diagram showing a modification of the FIG. 1B embodiment.

FIG. 6B shows a modification of the second embodiment shown in FIG. 1B. In the FIG. 6B embodiment, +1 button 88 and −1 button 89 are provided in the correction device 8.

Although, in the present invention, description has been made taking the case, as an example, where the selection is made in the order of the digital mode, analog mode, and lock mode, but, of course, the same operations can be performed if switching is made from the lock mode to the analog mode (III) and from the analog mode to the digital mode (IV).

Further, although the lock mode reset switch 86 has been interlocked with the opening and shutting movement of the lid 85 in the above described embodiment, the same may be linked with the motions for locking and unlocking the lock to provide the same effects.

According to the present device, since, as described in the foregoing, the apparatus is provided with a switch to be actuated by the shu-ting movement of the front lid covering the panel face having various switches for time correction arranged thereon, and it is adapted such that returning to the lock mode is achieved by the operation of this switch, the time correcting switches can be automatically returned to the lock mode even if it was forgotten to return them to the lock mode before shutting the front lid, and therefore, malfunction of the apparatus is prevented from occurring.

Now, description of details of the present invention will be given in the following based on the third embodiment.

FIG. 1 shows a central portion of a time recorder to which the present invention is applied. This mechanism is broadly constituted by a clutch mechanism 10 driven by a step motor 19, a printing wheel assembly 20 driven by the clutch mechanism 10, a transmission mechanism 30 (FIG. 4) for transmitting rotation to hands 37 and 38 through a minute reduction wheel 7, a card feed mechanism 40 supplied with driving force from a date printing wheel 24 as shown in FIG. 6 for carrying out an operation to stepwisely feed a card c, and a print mechanism 50 for printing date and time in the inserted card c.

Describing detailed mechanism of each of these portions, a clutch wheel 12 engaging with a pinion 19*a* fixed on the shaft of a step motor 19 is loosely disposed on a clutch wheel shaft 11 supported between front and back plates 1 and 2, and also on this clutch wheel shaft 11, there are loosely mounted a minute clutch wheel 13 and a date clutch wheel 15 axially urged by coil springs 14 inserted between the minute clutch wheel 13 and the front plate 1 and between the date clutch wheel 15 the back plate 2 so as to squeeze the clutch wheel 12 from both sides.

FIG. 2 shows the clutch mechanism 10 in an exploded manner. On both sides of the clutch wheel 12, there are provided, integrally formed therewith and projected therefrom, a minute feed cylinder 12*a* and a date feed cylinder 12*b* with clutch pawls provided on their end faces in the opposite directions to each other. The minute clutch wheel 13 and the date clutch wheel 15 are respectively provided on their inner end faces with a minute feed cylinder 13*a* and a date feed cylinder 15*a* projected therefrom. Through engagement between the clutch pawls provided on these end faces and the clutch pawls on both sides of the clutch wheel 12, when the clutch wheel 12 has made one complete clockwise rotation, in the drawing, every minute, the minute clutch wheel 13 in engagement with the minute feed cylinder 12*a* rotates a minute printing wheel 22 one step through the minute reduction wheel 17 (FIG. 6), and when the clutch wheel 12 has made a counterclockwise rotation, in the drawing, at 12 o'clock at night everyday, the date clutch wheel 15 in engagement with the date feed cylinder 12*b* rotates the date printing wheel 24 one step through a date reduction wheel 18.

Returning to FIG. 1, the printing wheel assembly 20 for printing date and time in a specific section of the time card c is made up of a minute printing wheel 22, hour printing wheel 23, and date printing wheel 24 of the same diameters. These three printing wheels 22, 23 and 24 are provided with typeface numerals 0 to 59, 1 to 24, and 1 to 31, respectively, protruded on their peripheral surfaces, and are disposed adjacent to each other. The date printing wheel 24 is in engagement with the date clutch wheel 15 through the date reduction wheel 18, and the hour printing wheel 23 is loosely mounted on a printing wheel shaft 21, while the minute printing wheel 22 in engagement with the minute clutch wheel 13 through the minute reduction wheel 17 is loosely mounted on a boss portion 23*a* of the hour printing wheel 23.

Referring to the drawing, reference numeral 25 denotes a ratchet wheel for driving the hour printing wheel 24. The ratchet wheel 25 is joined to the end portion of the boss portion 23*a* of the hour printing wheel 23 and adapted to rotate integrally therewith for driving the hour printing wheel 23. As shown in FIGS. 3 and 6, twenty four pieces of ratchet teeth provided on the peripheral surface of the ratchet wheel 25 are put in engagement with a reverse motion preventing pawl 25 and a feed pawl 27. The f-ed pawl 27 is pivotally supported for swinging movement by an arm end 28*b* of a feed lever 28 pivotally supported by a fixed shaft 29. By a swing of a cam follower 28*a* at the other end of the feed lever 28 sliding along the peripheral surface of a comma-shaped cam 22*a* integral with the minute printing wheel 22, the ratchet wheel 25 is pawl-fed one step each hour, and thereby the hour printing wheel 23 integral therewith is fed one step in the clockwise direction in the drawing.

On the other hand, on the plane in parallel with the paper surface of FIG. 1, that is, on the plane perpendicular to the front plate 1 and the back plate 2, there is provided a clock front plate 31. FIG. 5 shows the transmission mechanism 30 provided on the clock front plate 31. In the space between the clock front plate 31 and a clock face 32 provided in front of the front plate 31, there is dispos-d a transmission wheel 35 in engagement with an hour-hand wheel 33 and a minute-hand pinion 34, and the transmission wheel 35 is further coupled through a pinion 36*a* with an intermediate transmission wheel 36 in engagement with a crown gear wheel 17*a* integral with the minute reduction wheel. Accordingly, the transmission wheel 35 is adapted to transmit rotations of the minute reduction wheel 17 in the ratio of 1:12 to an hour hand 37 and to a minute hand 38.

Describing now the card feed mechanism 40 (FIG. 6) which is driven by the driving force supplied from the date printing wheel 24, a first step-feed wheel 41 constituting the card feed mechanism 40 is put on the printing wheel shaft 21 adjacent to the date printing wheel 24, and the end of a cantilever-shaped pawl piece 41*a* formed by punching method in its face is put in engagement with a ratchet inner tooth 24*a* formed on the side face of the date printing wheel 24, whereby the same is adapted, as the date printing wheel 24 rotates in the direction indicated by the arrow in the drawing once a day, to move one step in the same direction.

FIG. 6 shows the print mechanism 50 provided within the main body at the rear portion. Close the backside of the printing wheel assembly 20, there is provided a card guide 49 for guiding the card c inserted from top of the main body 4 mounted within a guide groove 2*b* in the back plate 2 enabled to move along the peripheral surface of the printing wheel assembly 20 in its axial direction. In the back of the same, there is disposed a hammer 51 rotating about a pin 51*a* serving as its fulcrum, with its front end positioned in the vicinity of the portion where the peripheral surface of the printing wheel assembly 20 abuts on the card c, and the same is adapted to be driven by a solenoid 52 which is actuated by a signal from the card detecting switch 47 actuated by movement of a switch lever 48 through a swing lever 53 cupled with a plunger 52*a*.

Figure 1C:
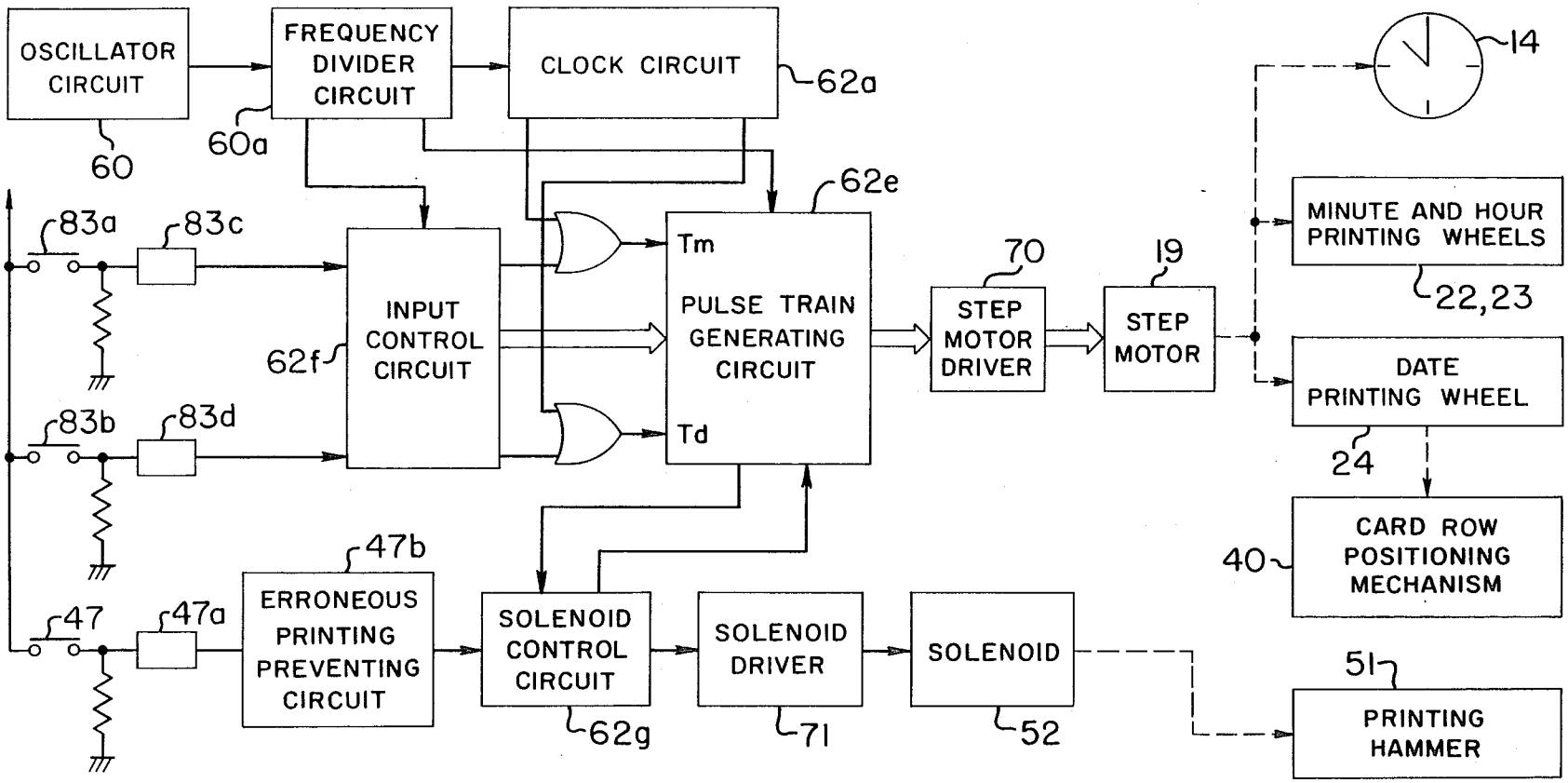
FIG. 1C is a block diagram of the apparatus indicating a third embodiment of the present invention.

FIG. 1C shows the third embodiment of the present invention, wherein 60 denotes an oscillator circuit for outputting a time reference signal, 60*a* denotes a frequency divider circuit for dividing the time reference signal and for outputting a timing signal, a pulse signal for the time correction, and pulses for driving the pulse motor 19, 62*a* denotes a clock circuit responsive to the timing signal for outputting a minute clock signal and a date clock signal, namely, shifting clock signals, at the intervals of one minute and 24 hours, respectively. Reference numeral 62*e* denotes a pulse train generating circuit for receiving pulses for the time correction, which are output from an input control circuit 62*f* in response to operations of an hour-minute feed switch 83*a* and a date feed switch 83*b*, and for receiving the minute clock signal and date clock signal from the clock circuit 62*a* at its terminal Tm and terminal Td for outputting motor driving control signals corresponding to the received signals, and the circuit 62*e* is adapted so as to temporarily suspend the delivery of the motor driving signal in the step motor driver 70 while a solenoid driving signal is output from a later discussed solenoid driver circuit 71. The solenoid control circuit 62*g* is adapted, on one hand, to output the solenoid driving control signal to the solenoid driver 71 when the card detecting switch is actuated and a signal is output from a later discussed erroneous printing preventing circuit 47*b*, and on the other hand, to suspend the delivery of the solenoid driving signal in the solenoid driver 71 when the motor driving signal is output from the step motor driver 70, temporarily for the period of time required for the printing wheel assembly to be fed one step.

Reference numeral 47*b* denotes the erroneous printing preventing circuit connected between the card detecting switch 47 and the solenoid control circuit 62*g*, and the erroneous printing preventing device 47*b* is, as shown in FIG. 2C, made up of a series circuit of a delay circuit 47*c* and a one-shot multivibrator 47*d* and adapted such that the one-shot multivibrator 47*d*, when a predetermined time $T_1$ has elapsed after the card detecting switch 47 is actuated, is driven to output a pulse signal stretched for a time $T_2$.

Reference numeral 70 in the drawing denotes the motor driver and 83*c*, 83*d* and 47*a* denote waveform shaping circuits.

Now operations of the apparatus of the above described structure will be described according to timing charts of FIG. 3C-1 and FIG. 3C-2.

If the minute clock signal from the clock circuit 62a is input to the pulse train generating circuit 62*e*, the number of pulses causing the step motor 19 to make a full rotation are output therefrom. Thereby, the clutch drive wheel 12 is rotated in the clockwise direction in the drawing through the pinion 19*a*, which causes the minute printing wheel 22 to rotate one printing line or step through the minute clutch wheel 13 and minute reduction wheel 17. In the case where the rotation is made when the type on the frame of the minute typing wheel 22, which faces the front end of the hammer 51, is set to "59", the cam follower 28*a* is caused to fall off the peripheral surface of the cam 22*a* integrally rotating therewith, whereby the feed lever is swung, the ratchet wheel 25 is allowed to be fed one tooth by the feed pawl 27 at the end of the feed lever, and the hour printing wheel 23 integrally rotating therewith is rotated a one-hour step.

Now, if the card c is inserted when the operation of the printing wheel assembly 20 has finished its operation, the front end of the card c abuts on the switch lever 48 (FIG. 6) of the card detecting switch 47, whereby this card detecting switch 47 is brought into an actuated state and outputs a dignal $P_1$. This signal $P_l$ is delayed by the time $T_l$ by the delay circuit: 47*c* of the erroneous printing preventing circuit 47*b*.

During the time $T_1$, the card c is further lowered so as to push down the lever 48 of the detecting switch 47 to a limit point, and the card is correctly positioned there. When the time $T_l$ has elapsed, the pulse signal of duration $T_2$ is output from the one-shot multivibrator 47*d*. The solenoid control circuit 62*g* is enabled at the leading edge of the pulse signal from the erroneous printing preventing circuit 47*b* to apply a solenoid driving control signal to activate the solenoid driver 71, whereby the date, hour, and minute are printed in a specified position of the card c by means of the printing hammer 51. And thus, it is prevented that the printed characters are vertically deviated out of place (FIG. 3C-1).

Now, when the printing has been finished and it is tried to take out the card c, but the card is pushed down, by mistake, in the middle of pulling it up, the lower end of the card again abuts on the switch lever 48 of the card detecting switch 47 to cause the signal $P_l$, to be output from the card detecting switch 47. In this case, however, the pulse signal of duration $T_2$ from the one-shot multivibrator 47*d* is still existing, and therefore, the solenoid control circuit 62*g* is in the disabled state and hence unable to cause the printing hammer 51 to operate. If the next card is inserted after the time interval $T_2$ necessary for one time of printing operation has elapsed, since the signal from the erroneous printing preventing circuit 47*b* already disappeared at this time, the solenoid control circuit 62*g* is enabled and the printing is performed. In the described manner, double printing in the card c is prevented (FIG. 3C-2). Immediately before the detecting switch 48 is operated by the card pushed in the time recorder, if the clock signal such as the minute signal or date signal is output from the clock circuit 62*a* and thereby the motor driving control signal is output from the pulse train generating circuit 62*e*, the solenoid control circuit 62*g* is brought into the disabled state by the motor driving control signal, whereby the printing hammer 51 is disabled even if the card detecting switch 48 is operated. And thus, the printing wheel assembly is fed with the increment corresponding to the minute signal or date signal, and when the feeding is finished and the motor driving control signal from the pulse train generating circuit 62*e* is turned off, the solenoid control circuit 62*g* is enabled and the date, hour, and minute are printed in the card c by the printing wheels just updated and set in the stationary state.

And, if the minute clock signal or date clock signal from the clock circuit 62*a* is output when the solenoid driving control signal is output from the solenoid control circuit 62*g* upon insertion of the card, the pulse train generating circuit 62*e*, in response to the solenoid driving control signal, maintains its disabled state and disables the step motor 19. Further, when the printing hammer 51 has finished its operation and the delivery of the solenoid driving control signal is stopped, the pulse train generating circuit 62*e* outputs the motor driving control signal corresponding to the minute clock signal or date clock signal that was input a while before, whereby the step motor 19 rotates so that the printing wheel assembly 20 is updated to the current time. While this step motor 19 is in rotation, the solenoid control circuit 62*g* is in receipt of the motor driving control signal, and so, the printing operation is temporarily suspended, and after the correction has been finished, the printing hammer 51 is driven to print the date, hour, and minute.

When it becomes 0:00 A.M., the date clock signal is output from the clock circuit 62*a*, and the motor driving control signal of the opposite phase to the minute motor driving control signal and at lower frequency is output from the pulse train generating circuit 62*e*. Thereby, the step motor 19 is rotated at lower speed in the opposite direction to that of the previous rotation. Then, the date clutch wheel 15 that has been stationary at that time is rotated and fed by clutch pawls provided on the date feed cylinder 12*b* of the clutch drive wheel 12, whereby the date typing wheel is rotated through the date reduction wheel 18 to make a one-day increment. As the date printing wheel 24 is rotated, the first step-feed wheel 41 is rotated by means of the pawl piece 41*a* in engagement with the ratchet inner tooth 24*a*, and thereby, the rack bar 43 is started to be elevated one row step by means of the rack feed gear wheel 42*a* of the second step-feed wheel 42 in engagement with the wheel 41.

Although the erroneous printing preventing circuit is constructed of the delay circuit 47*c* and the one-shot multivibrator 47*d* in the above described embodiment, the same effect can be provided by a circuit structure having, in essence, the functions to deliver a signal when a time $T_1$ has elapsed after a signal has been input thereto, and, until a time $T_2$ elapses after the delivery of the signal, to suppress generation of any new signal.

According to the present invention, as described in the foregoing, the signal from the card detector is arranged to be delayed a predetermined time before being input to the driving circuit of the printing hammer, it is made possible to print the time information in a specified position of the card irrespective of the time difference between the actuation of the card detector and the positioning of the card in place.

Now, description of details of the present invention will be given in the following based on the fourth embodiment.

FIG. 1 shows a central portion of a time recorder to which the present invention is applied. This mechanism is broadly constituted by a clutch mechanism 10 driven by a step motor 19, a printing hweel assembly 20 driven by the clutch mechanism 10, a transmission mechanism 30 (FIG. 4) for transmitting rotation to hands 37 and 38 through a minute reduction wheel 17, a card feed mechanism 40 supplied with driving force from a date printing wheel 24 for making an operation to stepwisely feed a card, and a print mechanism 50 for printing date and time information in an inserted card c.

Describing detailed mechanism of each of these portions, a clutch drive wheel 12 engaging with a pinion 19*a* fixed on the shaft of a step motor 19 is loosely mounted on a clutch wheel shaft 11 supported between front and back plates 1 and 2, and also on this clutch wheel shaft 11, there are loosely mounted a minute clutch wheel 13 and a date clutch wheel 15 axially urged by coil springs 14 inserted between the minute clutch wheel 13 and the front plate 1 and between the date clutch wheel 15 and the back plate 2 so as to squeeze the clutch wheel 12 from both sides.

FIG. 2 shows the clutch mechanism 10 in an exploded manner. On both sides of the clutch drive wheel 12, there are provided, integrally formed therewith and projected therefrom, a minute feed cylinder 12*a* and a date feed cylinder 12*b* with clutch pawls provided on their end faces in the opposite directions to each other. The minute clutch wheel 13 and the date clutch wheel 15 are respectively provided on their inner end faces with a minute feed cylinder 13*a* and a date feed cylinder 15*a* projected therefrom. Through engagement between the clutch pawls provided on these end faces and the clutch pawls on both sides of the clutch wheel 12, when the clutch drive wheel 12 has made one clockwise rotation, in the drawing, every minute, the minute clutch wheel 13 in engagement with the minute feed cylinder 12*a* rotates a later described minute printing wheel 22 one step through the minute reduction wheel 17 (FIG. 7), and when the clutch wheel 12 has made a counterclockwise rotation, in the drawing, at 12 o'clock at night everyday, the date clutch wheel 15 in engagement with the date feed cylinder 12*b* rotates the date printing wheel 24, to be described later, one step through a date reduction wheel 18.

Returning to FIG. 1, the printing wheel assembly 20 for printing date and time in a specific section of the time card c is made up of a minute printing wheel 22, a hour printing wheel 23, and date printing wheel 24 of the same diameters. These three printing wheels 22, 23 and 24 are provided with typeface numerals 1 to 60, 1 to 24, 1 to 31, respectively, protruded on their peripheral surfaces, and are disposed adjacent to each other. The date printing wheel 24 is in engagement with the date clutch wheel 15 through the date reduction wheel 18, and the hour printing wheel 23 is loosely put on a printing wheel shaft 12, while the minute printing wheel 22 in engagement with the minute clutch wheel 13 through the minute reduction wheel 17 is loosely put on a boss portion 23*a* of the hour printing wheel 23.

Referring to the drawing, reference numeral 25 denotes a ratchet wheel for driving the hour printing wheel 23. The ratchet wheel 25 is joined to the end portion of the boss portion 23*a* of the hour printing wheel 23 adapted to rotate integrally therewith for driving the same. As shown in FIGS. 1 and 3, twenty four pieces of ratchet teeth provided on the peripheral surface of the ratchet wheel 25 are put in engagement with a reverse motion preventing pawl 26 and a feed pawl 27. The feed pawl 27 is pivotally supported for swinging movement by an arm end 28*b* of a feed lever 28 pivotally supported by a fixed shaft 29. By a swing of a cam follower 28*a* at the other end of the feed lever 28 sliding along the peripheral surface of a comma-shaped cam 22*a* integral with the minute printing wheel 22, the ratchet wheel 25 is pawl-fed one step each hour, and thereby the hour printing wheel 23 integral therewith is fed one step in the clockwise direction in the drawing.

On the other hand, on the plane in parallel with the paper surface of FIG. 1, that is, on the plane perpendicular to the front plate 1 and the back plate 2, there is provided a clock front plate 31. FIG. 4 shows the transmission mechanism 30 provided on the clock front plate 31. In the space between the clock front plate 31 and a clock face 32 provided in front of the front plate 31, there is disposed a transmission wheel 35 in engagement with an hour-hand wheel 33 and a minute-hand pinion 34, and the transmission wheel 35 is further coupled through a pinion 36*a* with an intermediate transmission wheel 36 in engagement with a crown gear wheel 17*a* integral with the minute reduction wheel 17 (FIG. 4), and thereby, the transmission wheel 36 is adapted to transmit rotations of the minute reduction wheel 17 in the ratio of 1:12 to the hour hand 37 and to the minute hand 38.

Describing now the card feed mechanism 40 (FIG. 6) which is driven by the driving force supplied from the date printing hweel 24, a first step-feed wheel 41 constituting the card feed mechanism 40 is put on the printing wheel shaft 21 adjacent to the date printing wheel 24, and the end of a cantilever-shaped pawl piece 41*a* formed by punching method in its face is put in engagement with a ratchet inner tooth 24*a* formed on the side face of the date printing wheel 24, whereby the first step-feed wheel 41 is adapted, as the date printing wheel 24 rotates in the direction indicated by the arrow in the drawing once a day, to move one step in the same direction.

FIG. 6 shows the print mechanism 50 provided within the main body at the rear portion. Close to the backside of the printing wheel assembly 20, there is provided a card guide 49 for guiding a card c inserted from top of the main body 4 mounted within a guide groove 2*b* in the back plate 2 enabled to move along the peripheral surface of the pring wheel assembly 20 in its axial direction. In the back of the same, there is disposed a hammer 51 rotating about a pin 51*a* serving as its fulcrum, with its front end positioned in the vicinity of the portion where the peripheral surface of the printing wheel assembly 20 abuts on the card c, and the same is adapted to be driven by a solenoid 52 which is actuated by a signal from the card detecting switch 47 actuated by movement of a switch lever 48 through a swing lever 53 coupled with a plunger 52*a*.

Figure 1D:
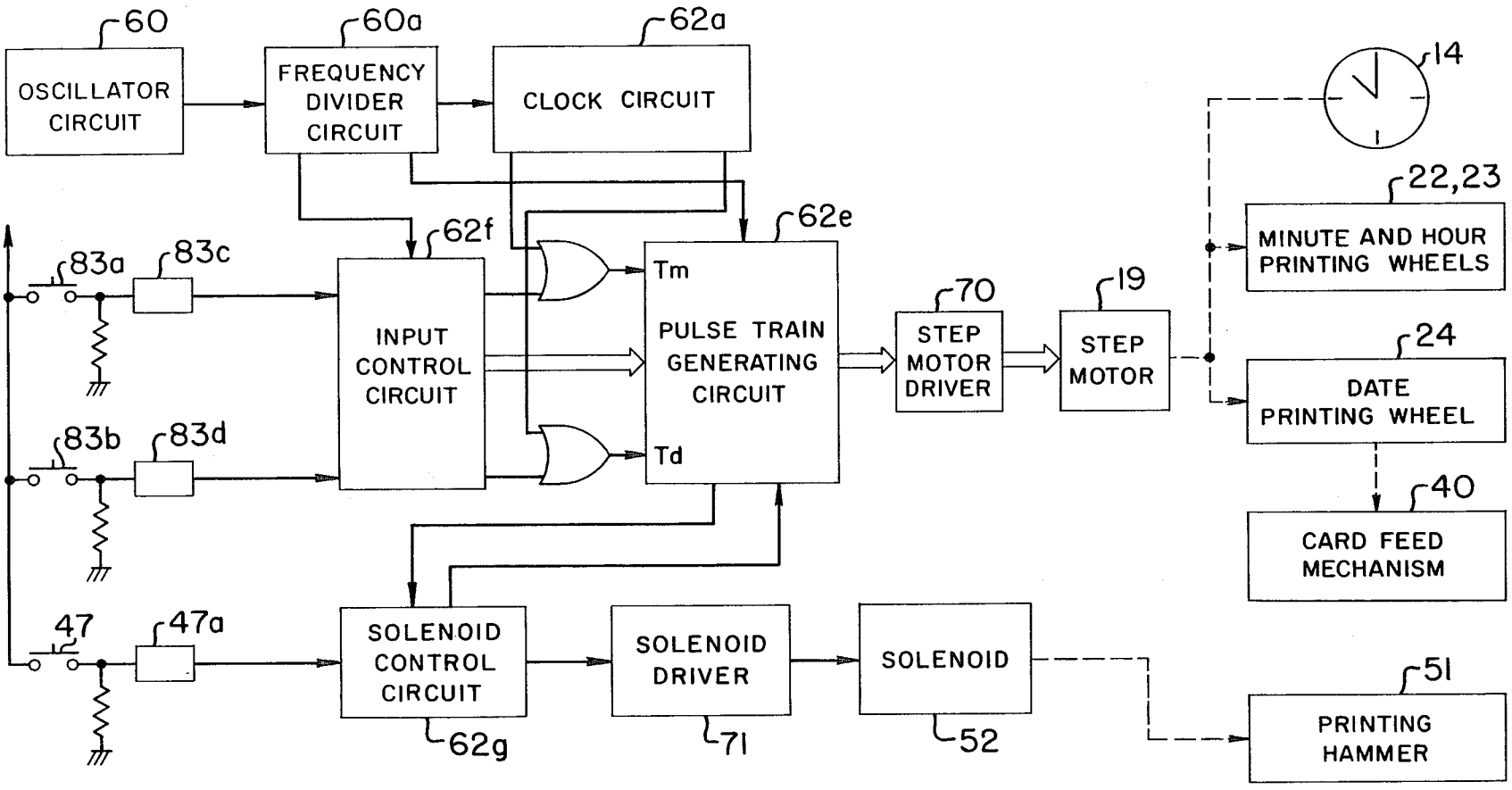
FIG. 1D is a block diagram of an apparatus indicating the fourth embodiment of the present invention, and FIGS. 2D-1, 2D-2 and, 2D-3 are timing charts showing operations of the above mentioned apparatus.

FIG. 1D shows the fourth embodiment of the present invention, wherein 60 denotes an oscillator circuit for outputting a reference signal, 60*a* denotes a frequency divider circuit for dividing the reference and signal for outputting a timing signal, a pulse signal for the correction, and later discussed pulses for driving the pulse motor, 62*a* denotes a clock circuit responsive to the timing signal for outputting a minute clock signal and a date clock signal, namely, shifting clock signals, at the intervals of one minute and 24 hours, respectively. Reference numeral 62*e* denotes a pulse train generating circuit for receiving pulses for the time correction, which are output from an input control circuit 62*f* in response to operations of an hour-minute feed switch 83*a* and a date feed switch 83*b*, and for receiving the minute clock signal and date clock signal from the clock circuit 62*a* at its terminal Tm and terminal Td for outputting motor driving control signals corresponding to the received signals. The pulse train generating circuit 62*e* is adapted in response to a solenoid driving control signal from a later discussed solenoid control circuit 62*g* to temporarily suspend the delivery of the motor driving control signal. The solenoid control circuit 67 is adapted, on one hand, to output the solenoid driving control signal to a solenoid driver 68 when the card detecting switch 47 is actuated, and on the other hand, to suspend the delivery of the solenoid driving control signal when the motor driving control signal is output from the pulse train generating circuit 62*e*, temporarily for the period of time required for the typing wheel assembly to be fed one step.

Reference numeral 70 in the drawing denotes a motor driver and 83*c*, 83*d* and 47*a* denote waveform shaping circuits.

Now operations of the apparatus of the above described structure will be described according to timing charts in FIGS. 2D-1, 2D-2 and 2D-3.

If the minute clock signal from the clock circuit 62*a* is input to the pulse train generating circuit 62*e*, the number of pulses causing the pulse motor 19 to effect a full rotation are output therefrom. Thereby, the clutch wheel 12 is rotated in the clockwise direction in the drawing through the pinion 19*a*, which causes the minute printing wheel 22 to rotate one printing line or step through the minute clutch wheel 13 and minute reduction wheel 17. In the case where the rotation is made when the type on the frame of the minute typing wheel 22, which faces the front end of the hammer 51, is set to "59", the cam follower 28*a* is caused to fall off the peripheral surface of the cam 22*a* integrally rotating therewith, whereby the feed lever 28 is swung, the ratchet wheel 25 is allowed to be fed one tooth by the feed pawl 27 at the end of the feed lever, and the hour printing wheel 23 integrally rotating therewith is rotated a one-hour step.

Figures 1, 2D:
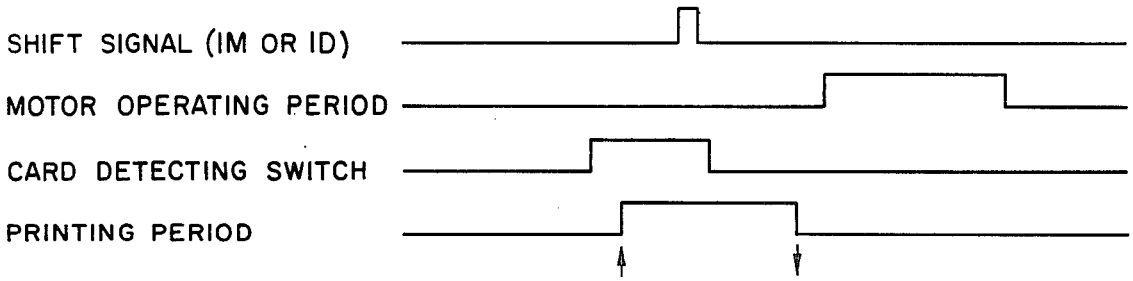
Figures 2, 2D:
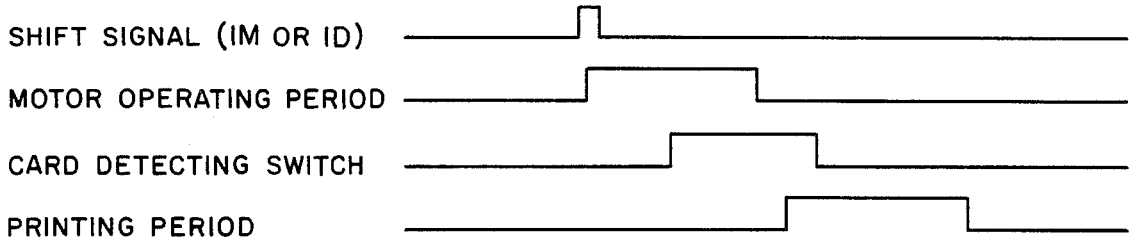
Figures 2, 2D, 3:
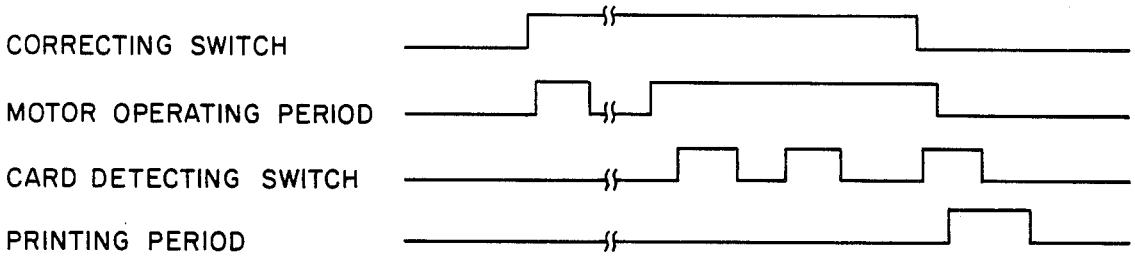

Now, if the card c is inserted when the operation of the printing wheel assembly 20 has finished its rotation, the card detecting switch 47 detects the card c, the solenoid 52 is driven by the solenoid control circuit 62g, and the date, hour, and minute are printed in the card by means of the typing wheel assembly 20 which is in a stationary state and the printing hammer 51. Immediately before the detecting switch 48 is operated by the card, if inserted into the time recorder the shift signal such as the minute clock signal or date clock signal is output from the clock circuit 62a and thereby the motor driving control signal is output from the pulse train generating circuit 62e, the solenoid control circuit 62g is brought into a disabled state by the motor driving control signal, whereby the printing hammer 51 is held stopped in the original or rest position even if the card detecting switch 48 is operated. And thus, the printing wheel assembly is fed one step in response to the minute clock signal or date clock signal, and when the feeding is finished and the motor driving control signal from the pulse train generating circuit 62e is turned off, the solenoid control circuit 62g is enabled and the date, hour, and minute are printed in the card c by the printing wheels just updated and put in a stationary state (FIG. 2D-2).

And, if the minute clock signal or date clock signal from the clock circuit 62a is output when the solenoid driving control signal is output from the solenoid control circuit 62g upon insertion of a card, the pulse train generating circuit 62e, in response to the solenoid driving control signal, maintains its disabled state and disables the pulse motor 19. And then, when the printing hammer 51 has finished its operation and the delivery of the solenoid driving control signal is stopped, the pulse train generating circuit 62e outputs the motor driving control signal according to the minute clock signal or date clock signal that was input a while before, whereby the pulse motor 19 rotates so that the printing wheel assembly 20 is updated to the current time. While this pulse motor 19 is in rotation, the solenoid control circuit 62g is in receipt of the motor driving control signal, and so, the printing operation is temporarily suspended, and after the correction has been finished, the printing hammer 51 is driven to print the date, hour, and minute (FIG. 2D-1).

When it becomes 0:00 A.M., the date clock signal is output from the clock circuit 62a, and a motor driving control signal of the opposite phase to the minute motor drive control signal and at lower frequency is output from the pulse train generating circuit 62e. Thereby, the step motor 19 is rotated at lower speed in the opposite direction to that of the previous rotation. Then, the date clutch wheel 15 that has been stationary at that time is rotated and fed by clutch pawls provided on the date feed cylinder 12b of the clutch wheel 12, whereby the date typing or printing wheel 24 is rotated through the date reduction wheel 18 to make a one-day increment. As the date printing wheel 24 is rotated, the first step-feed wheel 41 is rotated by means of the pawl piece 41a in engagement with the ratchet inner tooth 24a, and thereby, the rack bar 43 is started to be elevated one row step by means of the rack feed gear wheel 42a of the second step-feed wheel 42 in engagement with the wheel 41.

Even if the card c is inserted in the middle of the above mentioned elevating operation, and thereby, the card detecting switch 48 is operated, the solenoid control circuit 62g in receipt of the motor driving control signal from the pulse train generating circuit 62e cannot output the solenoid driving control signal for the reason previously mentioned, and so, the printing is performed after the elevating operation for one row portion has been finished.

If the correcting buttons 83a and 83b are operated to bring the typing wheel assembly 20 into a correct position after the apparatus has been suspended for some time due to a power failure, then, pulses for the correction corresponding to the date clock signal or minute clock signal are input through the input control circuit 62f to the pulse train generating circuit 62e. Thereby, the pulse train generating circuit 62e outputs the motor driving control signal to the step motor 19 that can rotate the typing wheel assembly 20 to make advance in date or minute. Even if the card c is inserted and the card detecting switch 48 is operated during the correcting process, the solenoid control circuit 62g in receipt of the motor driving control signal is unable to output the solenoid driving control signal similarly to the above described case.

When the correcting process has been ended and delivery of the motor driving control signal is stopped, the solenoid control circuit 62g is enabled and, in conjunction with the signal from the card detecting switch 48, actuates the solenoid 52 to perform the printing (FIG. 2D-3).

FIG. 1C shows a modification of the fourth embodiment shown in FIG. 1D, wherein reference numeral 47b denotes an erroneous printing preventing circuit connected between the card detecting switch 47 and the solenoid control circuit 62g, and the circuit 47b is, as shown in FIG. 2C, made up of a series circuit of a delay circuit 47c and a one-shot multivibrator 47d and adapted such that the one-shot multivibrator 47d, when a predetermined time $T_1$ has elapsed after the card detecting switch 47 is actuated, is driven to output a pulse signal stretched for a time $T_2$.

Figure 3B:
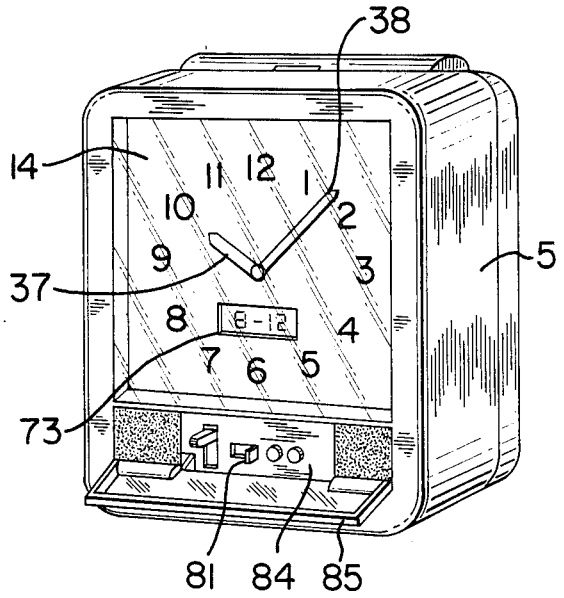
FIG. 3B is a front view of the apparatus to which the present invention is applied.
Figures 1, 3C:
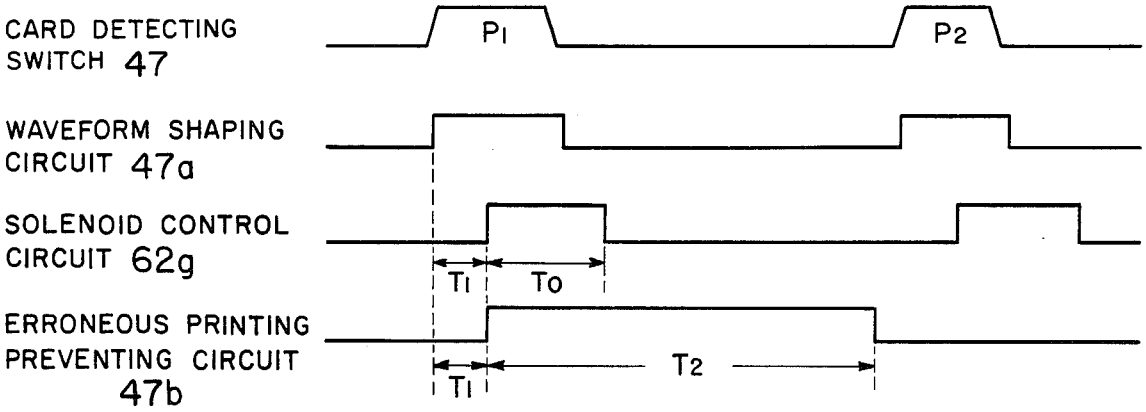
Figures 2, 3C:
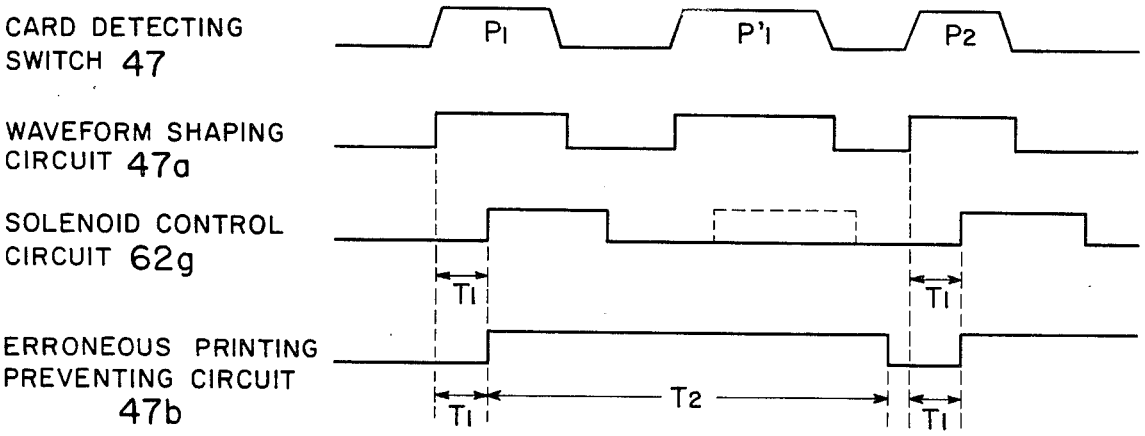

In the modified embodiment, as shown in FIGS. 3C-1 and 3C-2, if the front end of the card c abuts on the switch lever 48 of the card detecting switch 47, this card detecting switch 47 is brought into an actuated state and outputs a signal $P_1$. This signal $P_1$ is delayed by the time $T_1$ by the delay circuit 47c of the erroneous printing preventing circuit 47b.

During the time interval $T_1$, the card c is further lowered to abut on the bottom end of the card guide 49, and the card is correctly positioned there. When the time $T_1$ has elapsed, the pulse signal of duration $T_2$ is output from the one-shot multivibrator 47d. The solenoid control circuit 62g is enabled at the leading edge of the pulse signal from the erroneous printing preventing circuit 47b to output a solenoid driving control signal, whereby the date, hour, and minute are printed in a specified position of the card c by means of the printing hammer 51. And thus, it is prevented that the printed characters are vertically slipped out of place (FIG. 3C-1).

Now, when the printing has been finished and it is tried to take out the card c, but the card is pushed down, by mistake, in the middle of pulling it up, the lower end of the card again abuts on the switch lever 48 of the card detecting switch 47 to cause the signal $P_1$, to be output from the card detecting switch 47. In this case, however, the pulse signal of duration $T_2$ from the multivibrator 47d is still existing, and therefore, the solenoid control circuit 62g is in a disabled state and hence unable to cause the printing hammer 51 to operate. If another card is inserted after the time $T_2$ necessary for one time of printing operation has elapsed, since the signal from the erroneous printing preventing circuit 47b already disappeared at this time, the solenoid control circuit 62g is enabled and printing is performed. In the described manner, double printing in the card c is prevented (FIG. 3C-2).

Although the erroneous printing preventing circuit is constructed of the delay circuit 47c and the one-shot multivibrator 47d in the above described embodiment, the same effect can be provided by a circuit structure having in essence the functions to deliver a signal when a time $T_1$ has elapsed after a signal has been input thereto, and, until a time $T_2$ elapses after the delivery of the signal, to suppress generation of any new signal.

While the erroneous printing preventing circuit is constructed in an independent configuration in the above described embodiment, it is possible to incorporate the same in the solenoid control circuit thereby to simplify the circuit design.

According to the present invention as described in the foregoing, one of the motor for driving the printing wheels and the solenoid for driving the printing hammer is rendered operable after it is confirmed that the other of the motor and the solenoid is in the disabled state, and so, it has been made possible to prevent both dislocation in printing and overload on the motor, and therefore, the provision of a highly reliable time recorder has been achieved.

Now, the present invention will be described in detail in conjunction with the fifth embodiment thereof shown in the drawing.

Figure 6E:
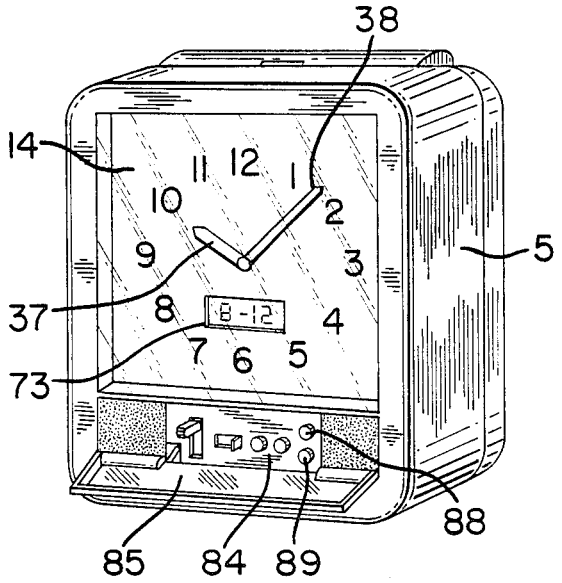
FIG. 6E is a front elevational view of a clock to which the present invention is applied.

FIG. 6E shows a clock to which the invention is applied. The clock includes an analog display mechanism 14 including an hour hand 37 and a minute hand 38 and located on a face of a casing 5 in which a signal processing circuit (FIG. 1E) which will be hereinafter described and an analog driving mechanism are contained. The clock further includes a digital display unit 73 such as a liquid crystal display panel located in a space of the analog display mechanism, and a panel 84 located at a lower portion of the front face of the casing 5 and adapted to be opened and closed by a front lid 85. A one-hour advance instruction button 88 and a one-hour back instruction button 89 (also refer to FIG. 7E) are located on the panel 84.

Figure 1E:
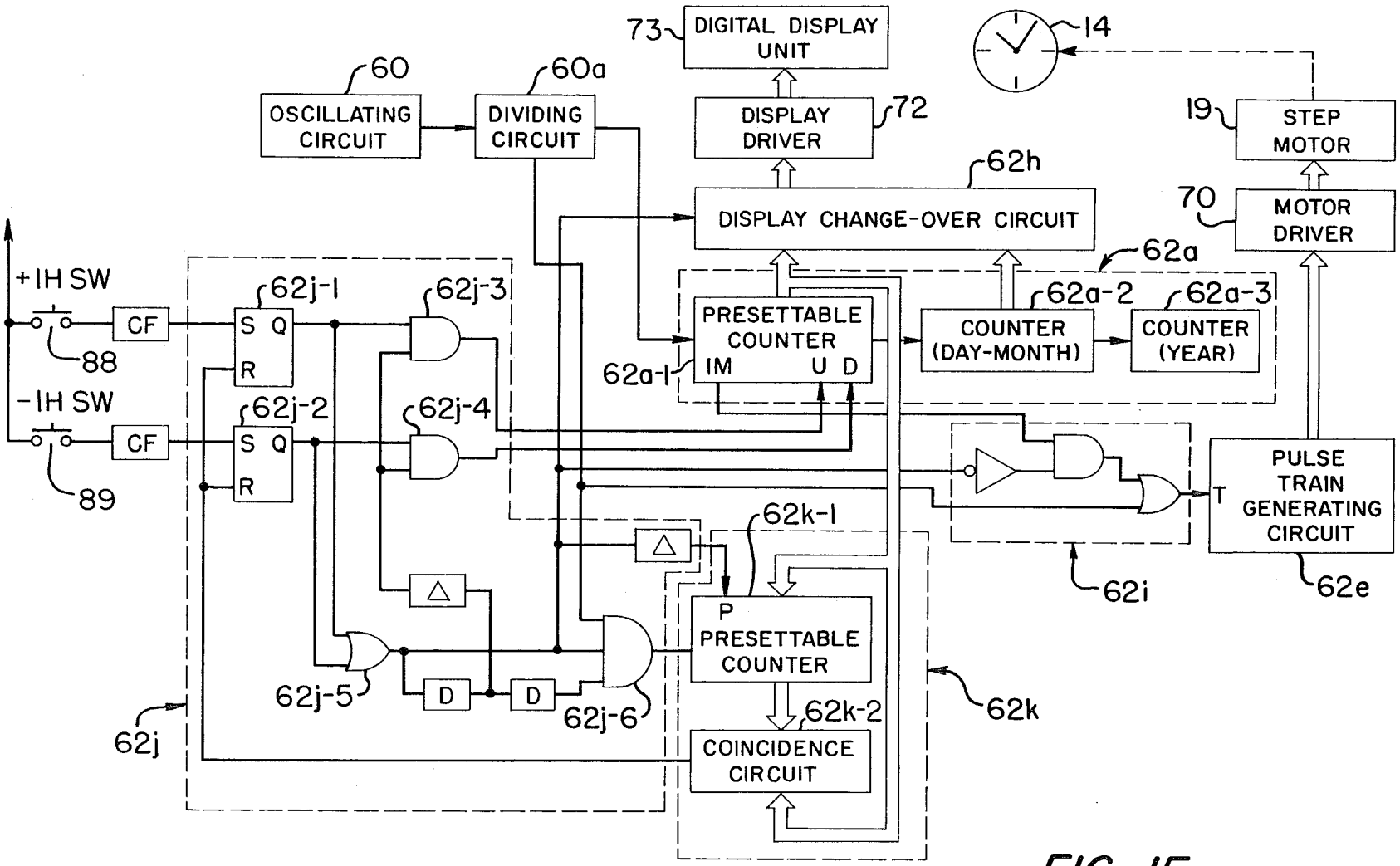
FIG. 1E is a block diagram of a clock showing the fifth embodiment of the present invention.
Figures 1, 2E:
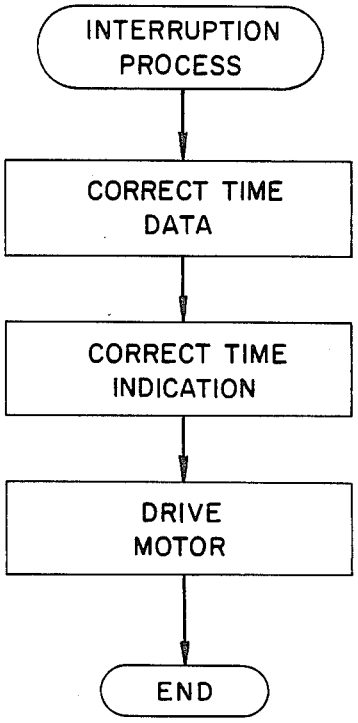
Figures 2, 2E:
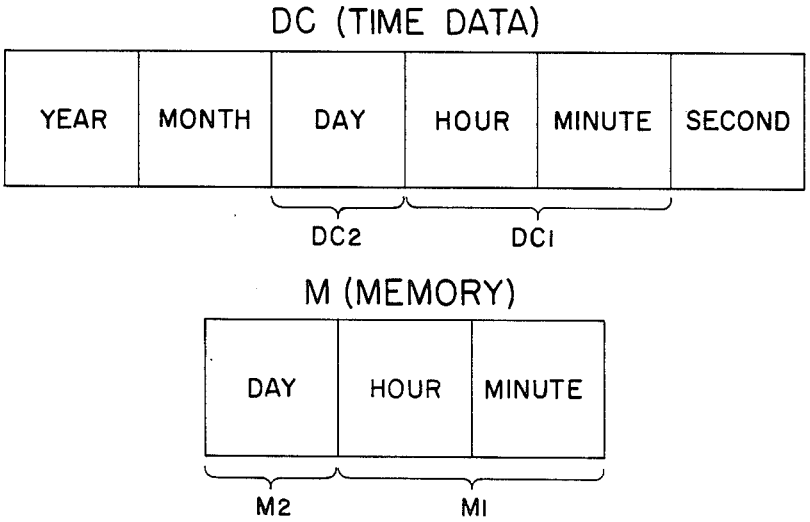
Figure 4B:
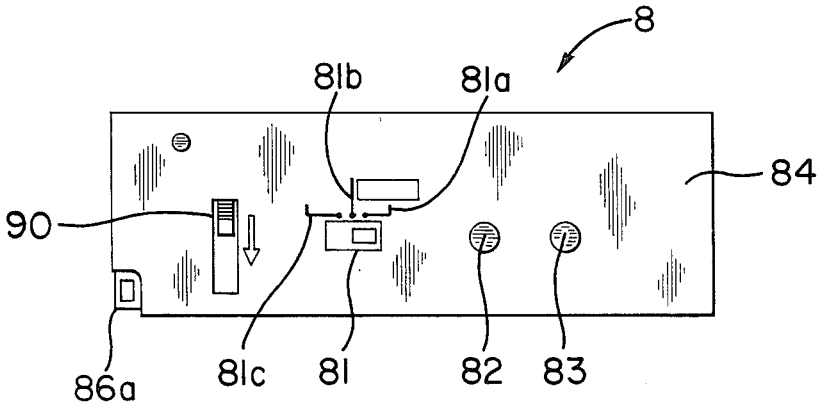
FIG. 4B is a front view showing a panel in the above mentioned apparatus.

Referring to FIG. 1E, there is illustrated a clock according to the fifth embodiment of the present invention. The clock includes an oscillating circuit 60 for generating reference signals, and a dividing circuit 60a for dividing the reference signals to produce second clock signals and correcting pulse signals. The clock further includes a clock circuit 62a for developing data regarding the year, month, day, hour, minute and second as shown in FIG. 2E-1. The clock circuit 62a includes a presettable counter 6a-1, and first and second counters 62a-2 and 62a-3. The presettable counter 62areceives second clock signals and develops data of the hour, minute and second and a carry signal for each minute. The presettable coutner 62a-1 further receives, at an up-terminal U and a down-terminal D thereof, a time correction signal produced by a time correction switch hereinafter described to increase or decrease the stored data by a unit of an hour. The first counter 62a-2 receives a signal for each hour from the presettable counter 62a-1 and produces data of the month and day, and the second counter 62a-3 receives a signal for each 24 hours from the first coutner 62a-2 and produces a signal of the year. The clock further includes a display change-over circuit 62h which receives data of the hour, minute and second and ata of the month and day from the clock circuit 62a and normally applies the data of the month and day to the digital display unit 73 to cause the digital display unit 73 to indicate the month and day, but when the correction switch is operated, the display change-over circuit 62h develops the data of the hour, minute and second from the presettable counter 62a-1 to cause the digital display unit 73 to indicate the hour, minute and second. The clock further includes a carry signal change-over circuit 62i which normally outputs a carry signal for each minute fed from the clock circuit 62a but outputs a correcting carry signal from the dividing circuit 60a when the correction is to be performed. The clock further includes a pulse train generating circuit 62e which applies to a stepping motor 19, when a carry signal is received from the carry change-over circuit 62i, a train of pulses for step-wisely driving the analog display mechanism 14 by an amount corresponding to one minute. The clock further includes a correction signal generating circuit 62j which includes a pair of flipflop circuits 62j-1 and 62j-2 which receive, at set terminals S thereof, signals from the one-hour advance instruction button 88 and the one-hour back instruction button 89 each consisting of an externally operable push button switch, respectively, and at reset terminals R thereof, a coincidence signal from an operating circuit 62k which will be hereinafter described. The correction signal generating circuit 62j further includes a pair of gate circuits 62j-3 and 62j-4 for delivering output signals from the flipflop circuits 62j-1 and 62j-2 to the up-terminal U and the down-terminal D of the presettable counter 62a-1, a gate 62j-5 for developing an output signal when the signal is developed from either one of the flipflop circuits 62j-1 and 62j-2, and another gate 62j-6 for delivering correcting pulse signals from the dividing circuit 60a during the correcting operation. The clock further includes the operating circuit 62k which includes a presettable counter 62k-1 and a coincidence circuit 62k-2. The presettable counter 62k-1 stores therein the current data of the day, hour and minute (FIG. 2E-2) delivered from the clock circuit 62a when the correction signal is received and adds the correction pulse from the correction signal generating circuit 62j to the stored data. Meanwhile, the coincidence circuit 62k-2 compares the results of the adding operation at the presettable counter 62k-1 with the present time data from the clock circuit 62a and develops a coincidence signal when the coincidence between the compared data is reached. The clock further includes drivers 72, 70 for driving the digital display unit 73 and the stepping motor 19, respectively.

Figure 3E:
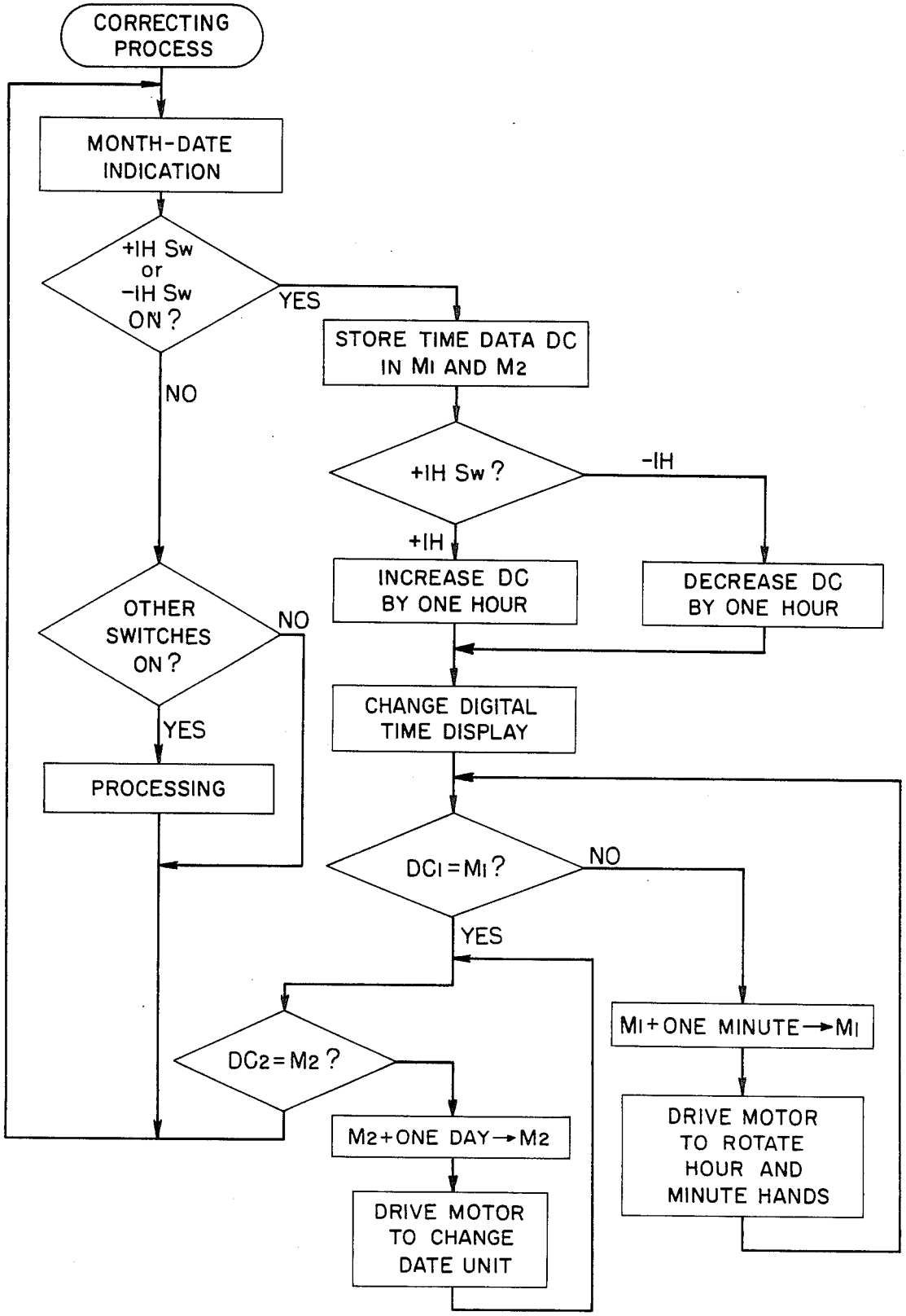
FIGS. 3E and 4E are a flow chart and a diagrammatic representation illustrating operation of the clock of FIG. 1E.

Now, operation of the system having such a construction as described above will be described with reference to a flow chart shown in FIG. 3E.

Figure 4E:
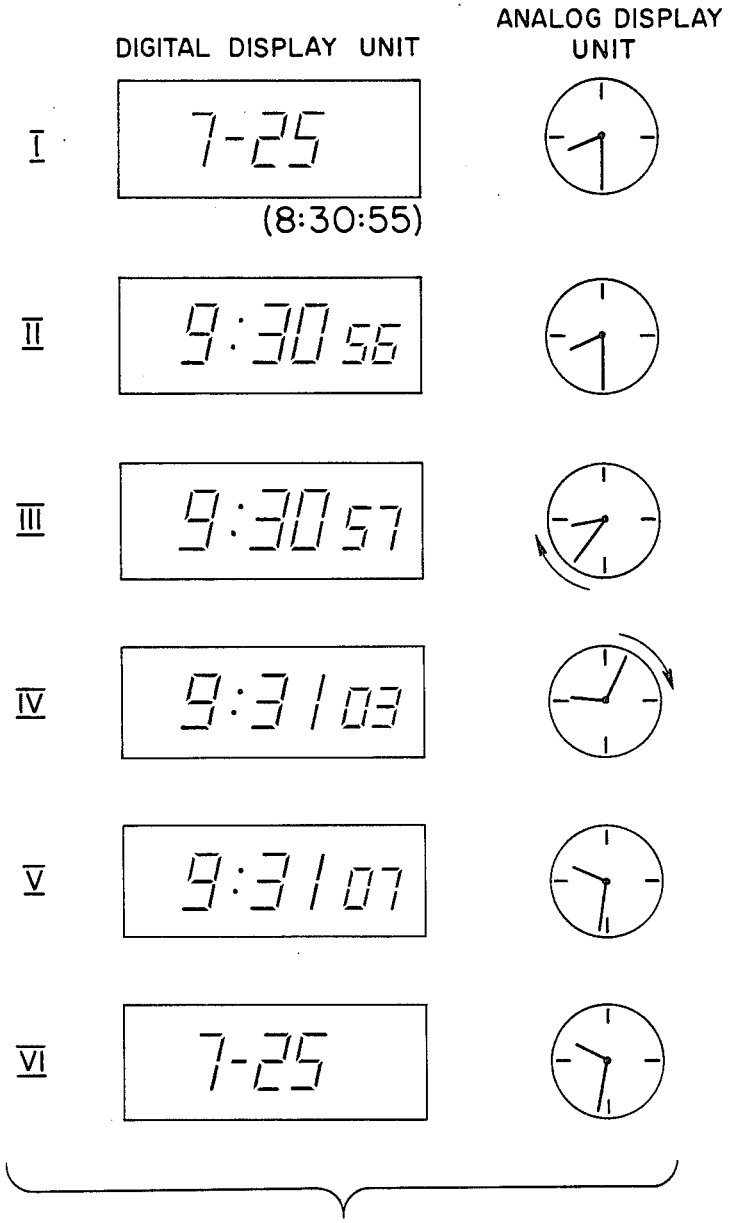

When neither of the instruction buttons 88 and 89 is operated, the digital display unit 73 receives the data of the month and day from the clock circuit 62a and provides indication of the month and day while the analog display mechanism 14 is driven by the stepping motor 19 operating in synchronism with a carry signal based on a minute signal from the clock circuit to indicate the hour and minute (I in FIG. 4E).

In such a normal indicating condition, if the one-hour advance instruction button 88 is depressed in order to put the hour indication forward by one hour, the flipflop 62j-1 of the correction signal generating circuit 62j is set to develop a signal. In response to the signal, the presettable counter 62k-1 of the operating circuit 62k stores the day data from the clock circuit 62a into a day data area M2 and the hour and minute data into an hour and minute data area M1 (FIG. 2E-2).

At the same time, the contents of the presettable counter 62a-1 of the clock circuit 62a-1 is advanced by one hour in response to the signal from the flipflop 62j-1, and the day, month and year data are also changed in connection therewith. At the same time, the display change-over circuit 62h is operated so that the contents of indication of the digital display unit 73 is changed over from the month and day to the hour, minute and second thus advanced (II in FIG. 4E).

On the other hand, after the changing of the flipflop 62j-1 of the correction signal generating circuit 62j into the set state, the correction pulses from the dividing circuit 60a are delivered, instead of the carry signal for each minute, from the carry signal change-over circuit 62i to the pulse train generating circuit 62e and also to the presettable counter 62k-1 of the operating circuit 62k. Thus, the pulse train generating circuit 62e causes the stepping motor 19 to rotate an amount corresponding to one minute to advance the analog display mechanism 14 by one minute each time the correction pulse is received. The presettable counter 62k-1 of the operating circuit 62k adds the correction pulses to the hour and minute data stored in the presettable counter 62k-1 just before the starting of the correcting operation to count the amount of stepping movement of the analog display mechanism. In this instance, when the results exceed one day, the data stored in the day data area is increased by one.

If the contents of the presettable counter 62k-1 corresponding to the indication of the time by the analog display mechanism 14, becomes coincident with the present time of the clock circuit 62a stored in the presettable counter 62a-1, a coincidence signal is developed from the coincidence circuit 62k-2 to reset the flipflop 62j-1 of the correction signal generating circuit 62j. As a result, the carry signal change-over circuit 62i again develops a carry signal for each minute to stepwisely feed the analog display mechanism 14 in accordance with the time, while the correction signal generating circuit 62j stops the development of the correction pulses to stop counting-up of the presettable counter 62k-1. At the same time the digital display unit 73 is changed over to indication of the month and day (VI in FIG. 4E), notifying that the correction of the time of the analog display mechanism 14 has completed.

Thereafter, each time the one-hour advance instruction button 88 is depressed, such a series of operations as described above will be repeated to correct the digital display unit 73 and the analog display mechanism 14.

On the other hand, if the one-hour instruction button 89 is depressed in order to put the hour indication back by a unit of hone hour, the flipflop 62j-2 of the correction signal generating circuit 62j is set to develop an instruction signal. In response to the instruction signal, the presettable counter 62k-1 of the operating circuit 62k stores therein the day, hour and minute data from the clock circuit 62a. At the same time, the contents of the presettable counter 62a-1 of the clock circuit 62a is put back by one hour in response to the instruction signal, and the day, month and year data are also changed in connection therewith. At the same time, the display change-over circuit 62h is operated so that the digital display unit 73 now indicates the hour, minute and second thus decreased.

After changing of the flipflop 62j-2 of the correction signal generating circuit 62j into the set state, correction pulses are delivered from the carry signal changeover circuit 62i to the pulse train generating circuit 62e and also to the presettable counter 62k-1 of the operating circuit 62k. The pulse train generating circuit 62e causes the stepping motor 19 to advance an amount corresponding to one minute to advance the analog display mechanism 14 by one minute each time the correction pulse is received. The presettle counter 62k-1 of the operating circuit 62k adds the correction pulses to the hour and minute data stored therein just before the starting of the correcting operation to count the amount of stepping movement of the analog display mechanism.

In this manner, the stepping motor 19 is advanced while the correction pulses are added to the hour and minute data ignoring the data of the day of the presettable counter 62k-1. As a result of such a correcting operation, a coincidence signal will be developed from the coincidence circuit 62k-2 to reverse the flipflop 62j-2 at a point of time when the hour and minute data of the presettable counter 62k-1 becomes coincident with the hour and minute data of the clock circuit 62a, namely, when the indication of the time by the analog display mechanism 14 is advanced by 23 hours. As a result, the carry signal change-over circuit 62i again develops a carry signal for each minute to step-feed the analog display mechanism 14 in accordance with the time, while the correction signal generating circuit 62j stops the development of correction pulses to stop counting up of the presettable counter 62k-1. At the same time, the digital display unit 73 is changed over to indication of the month and day, notifying that the correction of the time of the analog display mechanism 14 has completed.

By the way, in the correcting operation for reversing by one hour, the method is employed that the analog display mechanism 14 is advanced by 23 hours instead of reversing the analog display mechanism 14. When the clock is incorporated, for example, into a calendar mechanism or a time recorder, printing wheels indicating the day and/or month among printing wheels which operate in an interlocking relationship with the analog display mechanism 14 may advance by an amount corresponding to one day or may advance to a next month. In such a case, the coincidence detecting circuit 62k-2 does not output a coincidence signal upon completion of the time correcting operation, and the day data in the day data storing area of the presettable counter 62k-1 is compared with the day data from the clock circuit 62a to deliver correction pulses to the presettable counter 62k-1 and the pulses train generating circuit to rotate the stepping motor 19 by a unit of 24 hours, that is, by a unit of one day to feed the day printing wheel and the month printing wheel interlocked with the analog display unit 14 toward the following date.

Thus, if the day data and the hour and minute data of the presettable counter 62k-1 become both coincident with the day data and the hour and minute data of the clock circuit 62a, respectively, the carry signal change-over circuit 62i again develops a normal carry signal for each minute to step-feed the analog display mechanism 14 in accordance with the time, while the correction signal generating circuit 62j stops the development of correction pulses to stop counting-up of the presettle counter 62k-1. At the same time, the digital display unit 73 is changed over to the indication of the month and day, notifying that the correction of the time of the analog display mechanism 14 has completed. As a result, the development of the correction pulses is stopped to put the time of the analog display mechanism 11 back by one hour while the date of the printing wheels is returned to the date before the time correction, thereby completing the correction operation.

It is to be noted that while in the present embodiment the indication of the date is corrected by way of the time feed mechanism, it is also possible to provide in the clock a clutch mechanism which operates in response to a one-hour back instruction signal from the correction signal generating circuit **62*j*** to allow independent correction of indication of the date.

Figure 5E:
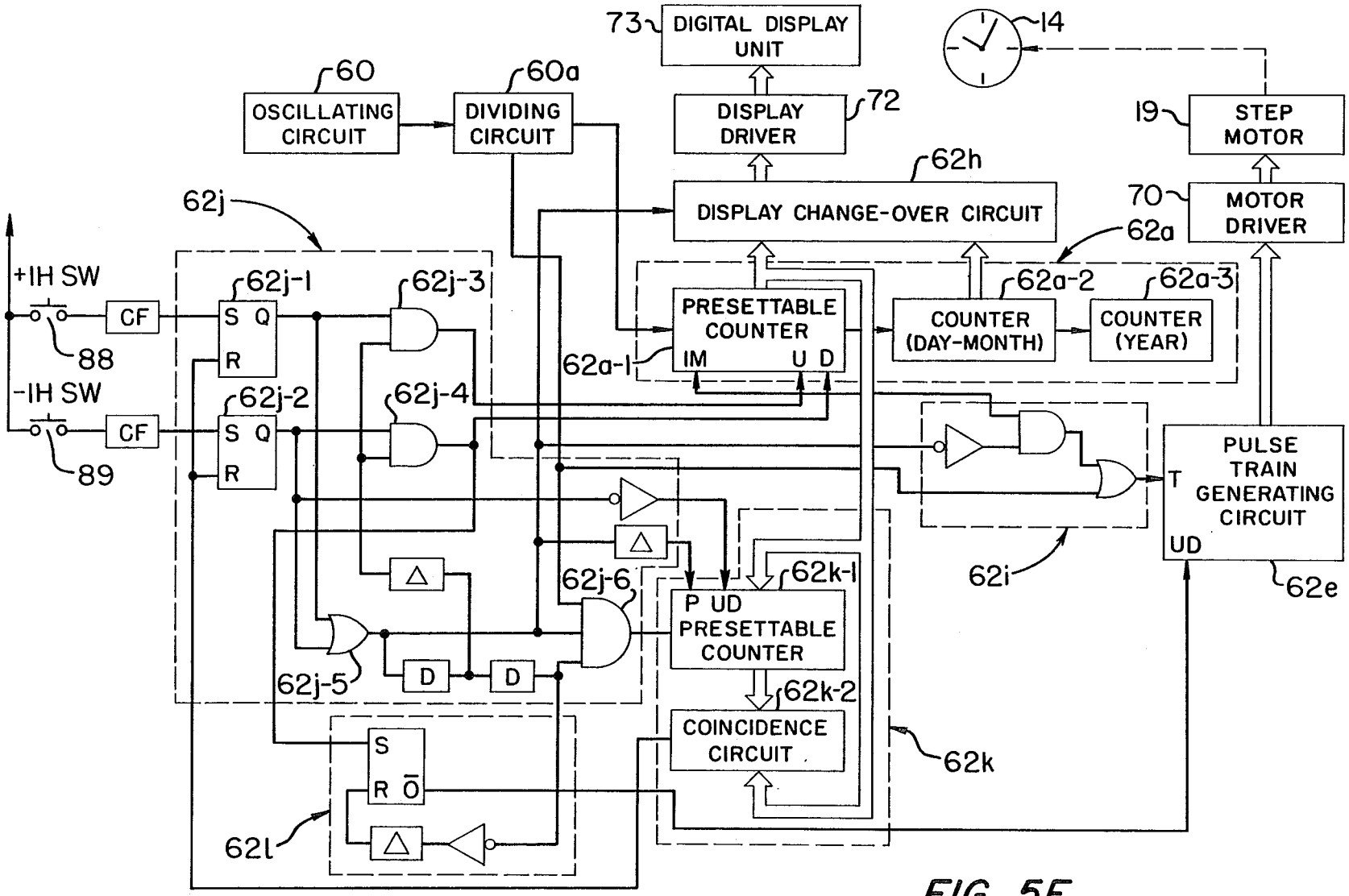
FIG. 5E is a block diagram of a system showing another embodiment of the invention.

Referring now to FIG. 5E, there is illustrated a modification of the fifth embodiment of the present invention in which an analog display mechanism is reversible. A reversing instruction circuit **62*e* is interposed between a one-hour back or reverse instruction output terminal of a correction signal generating circuit 62*j* and an up/-down terminal UD of a pulse train generating circuit 62*e* so that when the one-hour back instruction signal is developed, output pulses of the pulse train generating circuit 62*e* are reversed in phase to reverse an analog display mechanism 14** in order to effect the correction for delay by one hour. According to the present embodiment, the correction for delay of the time can be accomplished in a short time similarly to the correction for lead of the time.

It is to be noted that while the unit in correction for delay and lead is an hour in the embodiments described above, naturally it may be set arbitrarily to a suitable value, for example, to 30 minutes or 15 minutes, in accordance with an object.

As apparent from the foregoing description, according to the present invention, data of a clock circuit just before correction is stored into a counter, and modification of data of the clock circuit in accordance with a signal corresponding to a predetermined time is enabled while at the same time correction pulses are delivered to the counter in response to the signal so that the correction pulses can be added to the data to stepwisely feed an analog display mechanism until the resultant data of such addition becomes coincident with the corrected time. Accordingly, correction by the unit of, for example, an hour, can be accomplished quickly. Besides, operations for correction to an from the summer time or for correction of indication of the date by the analog display mechanism can be done quickly and simply.

What is claimed is:

1. A time recorder comprising: a digital display portion for displaying the time; a step motor; an analog display portion having hour and minute hands and a transmission mechanism, and driven by said motor through the transmission mechanism for displaying the time with the hour hand and the minute hand; a typing wheel assembly driven by said step motor for indicating the time to be printed in a time card and corresponding to the time displayed in the analog display portion; a card row positioning mechanism driven by said step motor for determining the printing position in a time card; a card detecting device for detecting insertion of a time card; a hammering mechanism responsive to an output from said card detecting device for printing the time indicated by said printing wheel assembly in a time card; a control circuit portion for controlling said digital display portion, step motor and hammering mechanism; and a correcting device connected to said control circuit portion for effecting corrections in said digital display portion, analog display portion, typing wheel assembly and card row positioning mechanism.

2. A time recorder comprising: hour and minute printing wheels rotatable for printing the time of hour and minute units in a time card; a date printing wheel rotatable for printing the date in the same time card; a driving power source; a rotating member coupled to the driving power source for undergoing bi-directional rotation; first means for transmitting the rotation of the rotating member to the hour and minute printing wheels; and second means for transmitting the rotation of the rotating member to the date printing wheel, both of said first and second means being coupled with said rotating member in opposed relation relative to the rotating member so as to transmit the rotation of the rotating member only in the opposite rotating directions to the hour and minute printing wheels and to the date printing wheel, respectively.

3. An analog-and-digital clcck comprising: a case; a clock circuit for producing a clock signal; an analog display mechanism and a digital display device disposed on the case for displaying the time in a normal mode in response to the clock signal from the clock circuit; switches for correcting the time displays on said analog display mechanism and digital display device; a panel face formed on the case for mounting the switches; a lid mounted on the panel face movable between open and shut positions to cover the panel face; and a detector mounted on the case and actuated by shutting motion of said lid to the shut position such that said analog display mechanism and digital display device are reset to the normal mode by means of a signal from said detector.

4. A time recorder comprising: a clock circuit for producing shift signals; printing wheels rotatably driven in response to the shift signals from the clock circuit to indicate time information to be printed in a time card; a card detector for detecting when a time card is inserted into the time recorder in opposed relation to the printing wheels and for outputting a corresponding detection signal; a delay circuit for delaying the detection signal to thereby produce a delayed signal; and a printing hammer operative in response to the delayed signal from said delay circuit for acting on the inserted time card against the printing wheels to print the time information indicated by the printing wheels on the time card.

5. A time recorder comprising: a clock circuit for producing shift signals; a card detector for detecting when a time card is inserted into the time recorder to produce a corresponding detection signal; a driving signal generating circuit responsive to the shift signals from the clock circuit for generating motor driving signals and responsive to the detection signal from the card detector for outputting a solenoid driving signal such that, while one of the motor and solenoid driving signals is being delivered, the delivery of the other of the motor and solenoid driving signals is temporarily suspended; a print mechanism comprised of printing wheels rotatably driven to indicate time information to be printed on the inserted time card, and a motor for driving the printing wheels in response to the motor driving signal; and means comprised of a printing hammer for acting on the inserted time card against the printing wheels to print the time information on the time card, and a solenoid for actuating the printing hammer in response to the solenoid driving signal.

6. A clock comprising: an analog display mechanism; an instruction button for developing a correcting instruction signal for time correction by a predetermined unit of time; a clock circuit for producing current time data therein and changing the current time data to correct time data corrected by the predetermined unit of time in response to the correcting instruction signal; a digital display device connected to the clock circuit for indicating the correct time data; a drive signal change-over circuit for selectively developing a quick drive signal at a high speed and a normal drive signal after each fixed interval of time; operating means operable in response to the correcting instuction signal for latching the current time data of said clock circuit therein and adding the high speed quick drive signal to the latched time data to change over said drive signal change-over circuit from the quick drive signal to the normal signal at a point of time when the results of addition become coincident with the correct time data of said clock circuit; and a stepping motor operable in response to the driving signals from said drive signal change-over circuit for driving the analog display mechanism to quickly correct the time indicated thereby according to the predetermined unit of time.

7. A time recorder for recording time information on a recording medium, comprising: control means including clock means for producing a clock signal, detecting means for detecting when a recording medium is loaded in the time recorder and producing a corresponding detection signal, and correcting means for producing a correcting signal effective to correct time information; display means for displaying time information; a printing wheel assembly rotationally driven to print the time information displayed by the display means; positioning means receptive of the loaded recording medium and movable relative to the printing wheel assembly for positioning the loaded recording medium in a print position relative to the printing wheel assembly; impact means opposed to the loaded recording medium and operative to impact the recording medium against the printing wheel assembly to thereby print the time information on the recording medium; first drive means controlled by the control means for driving the display means, printing wheel assembly and positioning means in synchronization with one another to thereby update and correct the time information displayed by the display means, the time information to be printed and the position of the recording medium in response to the clock and correcting signals; and second drive means controlled by the control means for actuating the impact means in response to the detection signal without relative interference with the first drive means.

8. A time recorder according to claim 7; wherein the printing wheel assembly comprises a plurality of printing wheels having numerical typefaces along their circumferential surfaces and rotationally driven to select designated typefaces indicative of the current time information.

9. A time recorder according to claim 7; wherein the printing wheel assembly includes a time printing wheel for printing time information and a date printing wheel for printing date information.

10. A time recorder according to claim 7; wherein the first drive means includes a motor bi-directionally rotatable in response to the clock signal, a pair of separate reduction gear trains for transmitting the rotation of the motor to the respective time and date printing wheels, and clutch means for selectively connecting one of the separate reduction gear trains to the motor according to the direction of motor rotation so as to rotate said one reduction gear train in one direction and to rotate the other reduction gear train in another direction.

11. A time recorder according to claim 7; wherein the impact means comprises a hammer pivotably actuated to act on the loaded recording medium.

12. A time recorder according to claim 11; wherein the second drive means comprises a solenoid for magnetically actuating the hammer.

13. A time recorder according to claim 7; wherein the control means includes delay means for delaying the application of the detection signal to the second drive means for a predetermined time interval so that the second drive means actuates the impact means after the predetermined time interval from the detection of the recording medium loading to thereby ensure the accurate positioning of the loaded recording medium relative to the printing wheel assembly.

14. A time recorder according to claim 7; wherein the control means includes means for controlling the first and second drive means to avoid relative interference with each other.

15. A time recorder according to claim 14; wherein the means for controlling includes means for regulating the first and second drive means to temporarily suspend the drive of either the printing wheel assembly or the impact means while the other thereof is being actuated.

16. A time recorder according to claim 7; wherein the positioning means includes means receptive of a loaded recording medium having a plurality of sections and movable relative to the printing wheel assembly for positioning a designated section of the loaded recording medium in the print position relative to the printing wheel assembly so that the current time information is printed on the designated section of the loaded recording medium.

17. A time recorder according to claim 16; wherein the first drive means includes means for updating the position of the recording medium once every day to thereby designate one of the recording medium sections.

18. A time recorder according to claim 7; wherein the correcting means includes a mode switch manually operable to set one of normal and correction modes in the time recorder and an input switch manually operable to input a correcting signal when the correction mode is set in the time recorder.

19. A time recorder according to claim 18; including a panel for mounting thereon the mode and input switches, and a lid disposed on the panel and movable between open and closed positions to cover the panel, the lid acting on the mode switch when moved to the closed position to thereby cause the mode switch to set the normal mode in the time recorder.

20. A time recorder according to claim 7; wherein the display means includes analog diaplay means driven by the first means for analogically displaying the time information, and digital display means driven directly by the control means according to the clock signal for digitally displaying time data.

21. A time recorder according to claim 20; wherein the correcting means includes input means for inputting a correcting signal effective to correct the time data displayed in the digital display means.

22. A time recorder according to claim 21; wherein the control means includes means for controlling the first drive means to quick-feed the analog display means until the time information displayed in the analog display means is quickly corrected to coincide with the corrected time data.

23. A time recorder according to claim 21; wherein the input means includes means for inputting a correcting signal effective to correct the time data by a predetermined amount of time interval.

* * * * *